US008242676B2

(12) United States Patent
Kim et al.

(10) Patent No.: US 8,242,676 B2
(45) Date of Patent: Aug. 14, 2012

(54) FIELD EMISSION DEVICE, FIELD EMISSION DISPLAY DEVICE AND METHODS FOR MANUFACTURING THE SAME

(75) Inventors: Yong-Jin Kim, Pohang-si (KR); Jin-Kyoung Yoo, Pohang-si (KR); Young-Joon Hong, Yongin-si (KR); Gyu-Chul Yi, Seoul (KR); Chul-Ho Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 151 days.

(21) Appl. No.: 12/490,163

(22) Filed: Jun. 23, 2009

(65) Prior Publication Data

US 2010/0156272 A1 Jun. 24, 2010

(30) Foreign Application Priority Data

Dec. 24, 2008 (KR) ..... 10-2008-0133885

(51) Int. Cl.
*H01J 9/02* (2006.01)

(52) U.S. Cl. ..... 313/310; 313/311; 313/495

(58) Field of Classification Search ..... 313/309–311, 313/495–497; 445/49–51
See application file for complete search history.

(56) References Cited

U.S. PATENT DOCUMENTS

| | | | | |
|---|---|---|---|---|
| 7,294,417 | B2 * | 11/2007 | Ren et al. | 428/701 |
| 2004/0105810 | A1 * | 6/2004 | Ren et al. | 423/624 |
| 2008/0067494 | A1 * | 3/2008 | Mammana et al. | 257/10 |

FOREIGN PATENT DOCUMENTS

| | | |
|---|---|---|
| KR | 10-2001-0084385 | 9/2001 |
| KR | 10-2003-0045848 | 6/2003 |
| KR | 10-2004-0102259 | 12/2004 |

OTHER PUBLICATIONS

Kim et al., "Position-controlled ZnO nanoflower arrays grown on glass substrates for electron emitter application," *Journal: Nanotechnology*, 19:1-5 (2008).

* cited by examiner

*Primary Examiner* — Bumsuk Won
(74) *Attorney, Agent, or Firm* — Birch, Stewart, Kolasch & Birch, LLP

(57) ABSTRACT

A field emission device, a field emission display device, and a method for manufacturing the same are disclosed. The field emission device includes: i) a substrate; ii) an electrode positioned on the substrate; iii) a mask layer positioned on the electrode and including one or more openings; and iv) a plurality of nanostructures positioned on the electrode via the openings and formed to extend radially. The plurality of nanostructures may be applied to emit an electron upon receiving a voltage from the electrode.

16 Claims, 32 Drawing Sheets

FIELD EMISSION DEVICE, FIELD EMISSION DISPLAY DEVICE AND METHODS FOR MANUFACTURING THE SAME

CROSS-REFERENCE TO RELATED APPLICATION

This application claims priority to and the benefit of Korean Patent Application No. 10-2008-0133885 filed in the Korean Intellectual Property Office on Dec. 14, 2008, the entire contents of which are incorporated herein by reference.

BACKGROUND OF THE INVENTION (a) Field of the Invention

The present invention relates to a field emission device, a field emission display device, and methods for manufacturing the same. More particularly, the present invention relates to a field emission device including a plurality of nanostructures that extend radially, a field emission display device, and their manufacturing methods.

(b) Description of the Related Art

With the advent of the information age allowing desired information to be easily acquired, portable devices that are simply carried around and have mobility are receiving much attention. Thus, display devices that can be easily carried around and are thin and light are being developed.

Liquid crystal display (LCD) devices are commonly used for portable devices, which, however, are disadvantageous in that the LCD devices have low visibility or clarity, a low response speed, and a narrow viewing angle. Thus, a field emission display (FED) is being developed to replace the LCD devices. The FED has high clarity and a wide viewing angle, and is thin and light.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a field emission device including nanostructures having advantages of good electron emission efficiency. The present invention has been also made in an effort to provide a field emission display device including the above-mentioned nanostructures. Further, the present invention has been made in an effort to provide a method for manufacturing the field emission device and the field emission display device.

An exemplary embodiment of the present invention provides a field emission device including: i) a substrate; ii) an electrode positioned on the substrate; iii) a mask layer positioned on the electrode and including one or more openings; and iv) a plurality of nanostructures positioned on the electrode via the openings and formed to extend radially. The plurality of nanostructures may be configured to emit electrons upon receiving a voltage from the electrode. Neighboring (mutually adjacent) nanostructures, among the plurality of nanostructures, may have an angle within the range of 20° to 60° therebetween. The angles between the neighboring nanostructures may be substantially the same. The plurality of nanostructures may include one or more nanostructures extending substantially at a right angle with respect to the surface of the substrate, and the other nanostructures may be positioned to be symmetrical based on the one or more nanostructures. End portions of one or more nanostructures, among the plurality of nanostructures, may have a pointed shape. When the end portions of the nanostructures are cut in a lengthwise direction of the nanostructures, the end portions may have the shape of an isosceles triangle, and a ratio of the height to the length of the base of the isosceles triangle may be 2 to 4.

One or more nanostructures, among the plurality of nanostructures, may have one or more shapes selected from the group consisting of a nanorod, a nanotube, a nanoneedle, and a nanowall. A ratio of the length of one or more nanostructures, among the plurality of nanostructures, obtained by cutting the one or more nanostructures in a direction perpendicular to the surface of the substrate to the length thereof obtained by cutting in a direction parallel to the surface of the substrate may be 10 or larger.

One or more nanostructures, among the plurality of nanostructures, may form an angle with the surface of the substrate within the range of 30° to 150°. The plurality of nanostructures may include a plurality of nanostructures extending substantially at a right angle to the surface of the substrate.

The field emission device according to an embodiment of the present invention may further include a seed layer formed between the substrate and the mask layer, wherein the material of the nanostructures may be the same as that of the seed layer. The nanostructures may grow from the seed layer.

One or more nanostructures, among the plurality of nanostructures, may include one or more elements selected from the group consisting of zinc oxide (ZnO), indium oxide (InO), tin oxide (SnO), tungsten oxide (WO), ferric oxide ($Fe_2O_3$), cadmium oxide (CdO), magnesium oxide (MgO), gallium nitride (GaN), aluminum nitride (AIN), silicon carbide (SiC), copper sulfide (CuS), copper oxide (CuO), molybdenum sulfide ($MOS_2$), molybdenum dioxide ($MoO_2$), molybdenum trioxide ($MoO_3$), tungsten (W), and molybdenum (Mo). One or more nanostructures may further include one or more elements selected from the group consisting of Al, Mg, Cd, Ni, Ca, Mn, La, Ta, Ga, Ln, Cr, B, N, and Sn.

Another embodiment of the present invention provides a field emission display device including: i) a first substrate; ii) a first electrode positioned on the first substrate; iii) a mask layer positioned on the first electrode and including one or more openings; iv) a plurality of nanostructures positioned on the first electrode and formed to extend radially at the openings; v) a second substrate positioned apart from the first substrate and including a phosphor layer formed on a surface facing the plurality of nanostructures; and vi) a second electrode facing the first substrate and positioned on the second substrate. The plurality of nanostructures may be configured to emit electrons upon receiving a voltage from the first electrode, and the electrons may collide with the phosphor layer to allow visible rays to emit via the second substrate.

Neighboring nanostructures, among the plurality of nanostructures, may form an angle within the range of 20° to 60° therebetween. The angles between the neighboring nanostructures may be substantially the same. The plurality of nanostructures may include one nanostructure at a right angle with respect to the surface of the substrate, and the other nanostructures may be positioned to be symmetrical based on the one nanostructure. End portions of one or more nanostructures, among the plurality of nanostructures, may have a pointed shape. When the pointed shape of the nanostructures is cut in a lengthwise direction of the nanostructures, the pointed shape may have the shape of an isosceles triangle, and a ratio of the height to the length of the base of the isosceles triangle may be 2 to 4. One or more nanostructures, among the plurality of nanostructures, may form an angle with the surface of the substrate within the range of 30° to 150°.

Yet another embodiment of the present invention provides a method for manufacturing a field emission device, including: i) providing a substrate to the interior of a chamber; ii) providing an electrode on the substrate; iii) providing a mask layer on the electrode; iv) etching the mask layer to form one or more openings; and v) forming a plurality of nanostructures on the electrode through the openings such that the plurality of nanostructures extend radially.

In the forming of the plurality of nanostructures on the electrode, the ratio of the diameter of the openings to that of one or more nanostructures, among the plurality of nanostructures, may be 10 or larger. The forming of the plurality of nanostructures on the electrode may include injecting a reactive precursor into the chamber, wherein the reactive precursor may be an aqueous solution including zinc nitrate and hexamethyltetramine.

The method for manufacturing a field emission device may further include providing a seed layer immediately on the electrode, and in the providing of the mask layer, the mask layer may be provided immediately on the seed layer, while in the forming of the plurality of nanostructures on the electrode, the plurality of nanostructures may grow from the seed layer so as to be formed. In the providing of the seed layer, the seed layer may be formed at room temperature or at 450° C.

Another embodiment of the present invention provides a method for manufacturing a field emission display device, including: i) providing a first substrate into a chamber; ii) providing a first electrode on the first substrate; iii) providing a mask layer on the first electrode; iv) etching the mask layer to form one or more openings; v) forming a plurality of nanostructures on the first electrode via the openings such that the nanostructures extend radially; vi) providing a spacer on the substrate; vii) providing a second electrode on the spacer; and viii) providing a second substrate with a phosphor layer formed thereon on a surface of the second electrode facing the plurality of nanostructures.

In the forming of the plurality of nanostructures on the first electrode, the ratio of the diameter of the openings to that of one or more nanostructures, among the plurality of nanostructures, may be 10 or larger. The forming of the plurality of nanostructures on the first electrode may include injecting a reactive precursor into the chamber, wherein the reactive precursor may be an aqueous solution including zinc nitrate and hexamethyltetramine.

The method for manufacturing a field emission display device may further include providing a seed layer immediately on the first electrode, and in the providing of the mask layer, the mask layer may be provided immediately on the seed layer, while in the forming of the plurality of nanostructures on the electrode, the plurality of nanostructures may grow from the seed layer so as to be formed. In the providing of the seed layer, the seed layer may be formed at room temperature or at 450° C.

According to an embodiment of the present invention, because the plurality of nanostructures are provided on the large area of the substrate, the field emission device can have the excellent electron emission efficiency. In addition, the manufacturing costs of the field emission device can be reduced.

DETAILED DESCRIPTION OF THE EMBODIMENTS

Figure 1:
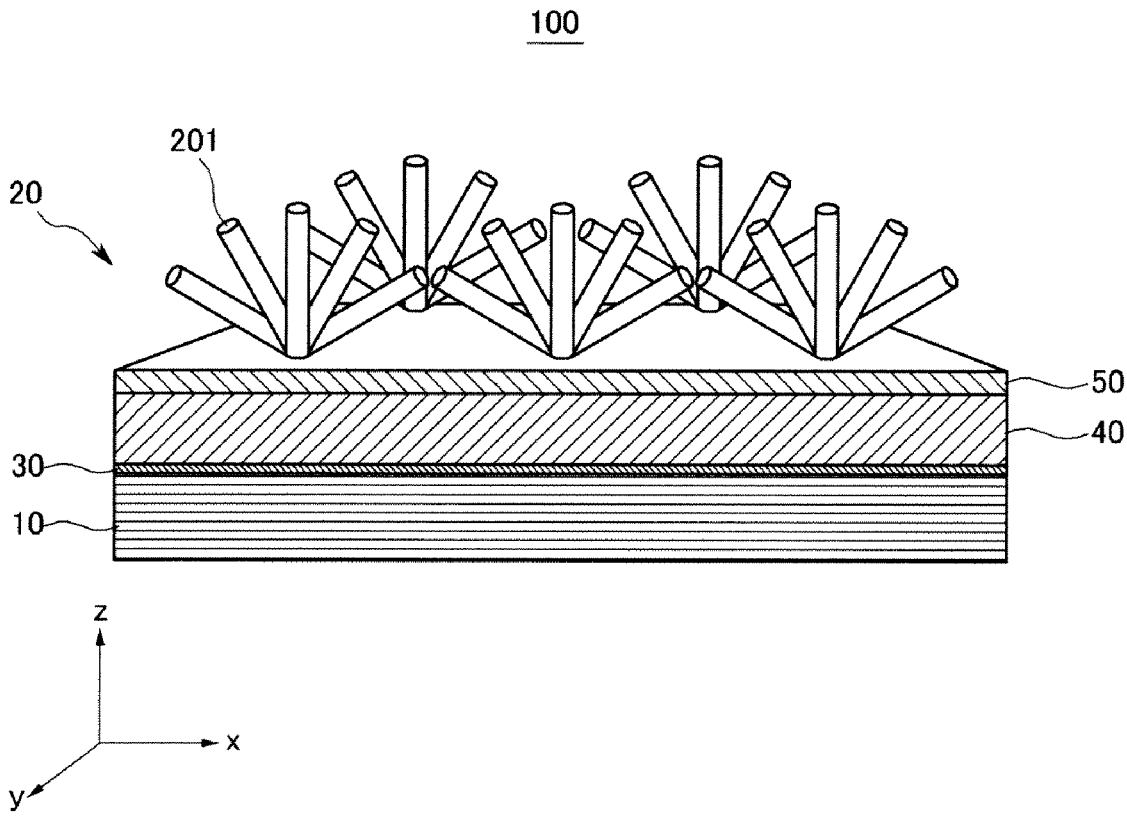
FIG. 1 is a schematic perspective view of a field emission device according to a first embodiment of the present invention.

It will be understood that when an element is referred to as being "on" another element, it can be directly on the other element or intervening elements may also be present. In contrast, when an element is referred to as being "directly on" another element, there are no intervening elements present.

The terms "first", "second", and "third" are used to explain various parts, components, regions, layers and/or sections, but it should be understood that they are not limited thereto. These terms are used only to discriminate one portion, component, region, layer, or section from another portion, component, region, layer, or section. Thus, a first portion, component, region, layer, or section may be referred to as a second portion, component, region, layer, or section without departing from the scope of the present invention.

The technical terms used herein are to simply mention a particular embodiment and are not meant to limit the present invention. An expression used in the singular encompasses the expression of the plural, unless it has a clearly different meaning in the context. In the present invention, it is to be understood that the terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

Terms indicating relative spaces such as "below", "above", and the like may be used to easily describe the relationships between elements illustrated in drawings. Such terms may be intended to include different meanings or operations of a device in use along with meanings intended by the drawings. For example, if a device on a drawing is reversed, it would be described that one element described to be "under" or "below" the other element may be described to be "on" or "above" the other element. Thus, terms illustrative of "under" or "below" may include all the downward and upward directions. A device may be rotated by 90° or other angles, and terms representing a relative space may be interpreted accordingly.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the meanings equal to the contextual meanings in the relevant field of art, and are not to be interpreted to have idealized or excessively formal meanings unless clearly defined in the present application.

The embodiments of the present invention described with reference to perspective views and sectional views substantially represent the ideal embodiments of the present invention. Consequently, illustrations are expected to be variously modified, that is, manufacturing methods and/or specifications are expected to be modified. Thus, the embodiments are not limited to a particular form of illustrated regions and, for example, modifications of forms according to manufacturing are also included. For example, a region illustrated or described to be flat may generally be rough or have rough and nonlinear characteristics. Also, a portion illustrated to have a pointed angle may be rounded. Thus, regions illustrated on drawings are merely rough and broad, and their forms are not meant to be illustrated precisely nor meant to narrow the scope of the present invention.

Nanobundles (nanoflowers) described hereinbelow refer to a set of a plurality of nanostructures. The nanobundles may be modified to any configuration without being limited to a particular shape.

Hereinafter, embodiments of the present invention will be described with reference to FIGS. 1 to 14. Such embodiments are to illustrate the present invention, and the present invention is not limited thereto.

FIG. 1 schematically shows a field emission device 100 according to a first exemplary embodiment of the present invention. The field emission device 100 of FIG. 1 has a nano-size, which is extremely small, and FIG. 1 shows a magnified form of the field emission device 100.

As shown in FIG. 1, the field emission device 100 includes a substrate 10, an electrode 30, a nanobundle 20, a seed layer 40, and a mask layer 50. The seed layer 40 may be omitted according to circumstances when the field emission device 100 is manufactured. The nanobundle 20 includes a plurality of nanostructures 201.

As a material of the substrate 10, quartz, glass, or polymer may be used. When the substrate 10 is made of such material, a large-scale substrate may be used because the fabrication cost of the field emission device 100 is low.

As shown in FIG. 1, the electrode 30 is formed on the substrate 10. An indium tin oxide (ITO) thin film may be formed as the electrode 30 on the entire surface of the substrate 10. Alternatively, the electrode 30 may be partially formed on portions where the nanobundles 20 are positioned. The electrode 30 is made of a conductive material and is provided with power from an external source, and applies a voltage to the nanobundles 20.

As shown in FIG. 1, the seed layer 40 is positioned on the electrode 30. The seed layer 40 has anisotropic surface energy. The seed layer 40 acts as a base thin film supporting the nanostructures 201. The seed layer 40 may be made of silicon, aluminum oxide, gallium arsenide, spinel, silicon, indium phosphide, gallium phosphide, aluminum phosphide, gallium nitride, indium nitride, aluminum nitride, zinc oxide, magnesium oxide, indium oxide (InO), tin oxide (SnO), tungsten oxide (WO), ferric oxide ($Fe_2O_3$), cadmium oxide (CdO), silicon carbide, titanium oxide, copper sulfide, copper oxide (CuO), molybdenum sulfide ($MoS_2$), molybdenum dioxide ($MoO_2$), molybdenum trioxide ($MoO_3$), tungsten (W), or molybdenum. The material of the nanostructure 20 may be the same as that of the seed layer 40.

A growth orientation of the nanostructure 201 may be adjusted by adjusting a crystal orientation of the seed layer 40. For example, if the crystal orientation of the seed layer 40 is aligned in a z-axis direction, the nanostructure 201 growing from the seed layer 40 may extend in the z-axis direction so as to be formed to be parallel to the seed layer 40. Thus, a spatial arrangement of the nanostructures 201 may be adjusted by adjusting the crystal orientation of the seed layer 40. A formation temperature of the seed layer may be adjusted at room temperature or at a relatively low temperature of 450° C. to produce the nanobundle 20 of a desired form.

The mask layer 50 is positioned on the seed layer 40. The mask layer 50 includes a plurality of openings 501. The plurality of openings 501 are formed to be spaced apart from each other with a certain pattern. Accordingly, the plurality of nanobundles 20 may be regularly arranged on the substrate 10. The position, interval, density, arrangement, and the like, may be adjusted by suitably using the mask layer 50. As a result, an electron emission efficiency of the nanobundles 20 can be maximized.

As shown in FIG. 1, the plurality of nanostructures 201 are spaced apart from each other to form a single flower (bundle). The plurality of nanostructures 201 extend radially and are formed separately, so an electric field supplied from an external source can be effectively applied to each nanostructure 201 and each nanostructure 201 can properly emit electrons.

In addition, because the interval (space, distance) between the plurality of nanostructures 201 is adjusted by using a selective growth method, an electric field provided from an external source can be effectively applied to each nanostructure 201. That is, electrons can be emitted from the respective nanostructures 201 by applying a low level electric field without having to apply a high level electric field. In addition, although not shown, the nanostructures 201 may not be formed as a bundle but as a single element.

As shown in FIG. 1, the nanobundles 20 are arranged along one plane, that is, along the x-axis direction and the y-axis direction. The plurality of nanobundles 20 are regularly arranged along the x-axis direction and the y-axis direction. Thus, among the plurality of nanobundles 20, neighboring nanobundles 20 have substantially the same distance therebetween. As a result, the space arrangement of the plurality of nanobundles 20 can be effectively adjusted, maximizing the efficiency of electron emission of the nanobundles 20.

As shown in FIG. 1, the nanostructure 201 may have a nanorod shape. Although not shown in FIG. 1, the nanostructure may also have various other shapes such as a nanotube, a nanowire, a nanowall, or the like.

As shown in FIG. 1, the nanostructure 201 may be fabricated with zinc oxide (ZnO), indium oxide (InO), tin oxide (SnO), tungsten oxide (WO), ferric oxide ($Fe_2O_3$), cadmium oxide (CdO), magnesium oxide (MgO), gallium nitride (GaN), aluminum nitride (AlN), silicon carbide (SiC), copper sulfide (CuS), copper oxide (CuO), molybdenum sulfide ($MoS_2$), molybdenum dioxide ($MoO_2$), molybdenum trioxide ($MoO_3$), tungsten (W), or molybdenum (Mo). The nanostructure 201 may further include Al, Mg, Cd, Ni, Ca, Mn, La, Ta, Ga, Ln, Cr, B, N, or Sn.

After the substrate 10 is connected to a power source and provided with power, the nanostructures 201 receive voltage applied from the substrate 10 and emit an electric field. In this manner, the field emission device 100 can emit an electric field.

Figure 2:
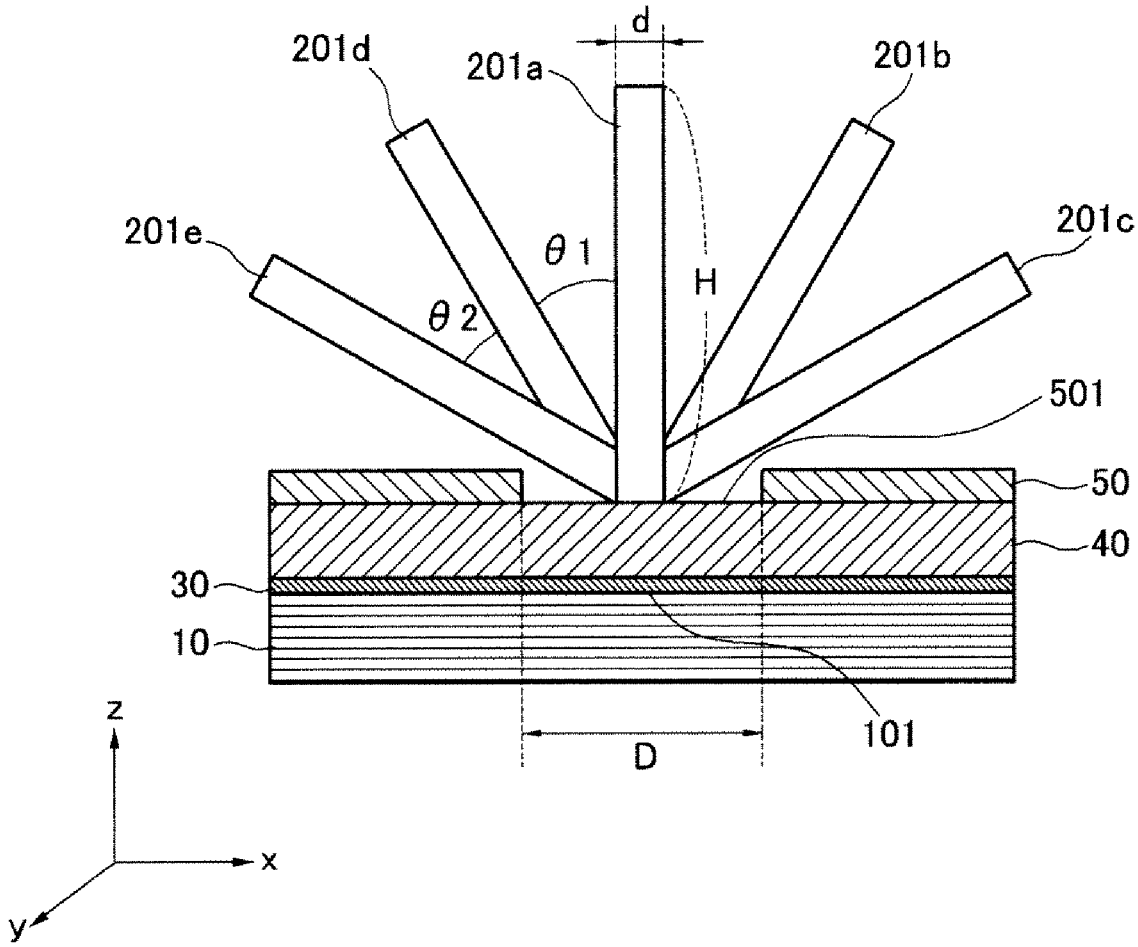
FIG. 2 is an enlarged view of the nanostructure included in the field emission device shown in FIG. 1.

FIG. 2 is a cross-sectional view of the nanobundle 20 taken along line II-II in FIG. 1. The plurality of nanostructures 201*a*, 201*b*, 201*c*, 201*d*, and 201*e* as shown in FIG. 2 are not meant to be nanostructures with particular positions and angles, but can be applicable to any nanostructures.

As shown in FIG. 2, the nanobundle 20 includes the plurality of nanostructures 201*a*, 201*b*, 201*c*, 201*d*, and 201*e*. The nanostructure 201*a* extends to be substantially perpendicular to the surface 101 of the substrate 10. That is, the nanostructure 201*a* extends in a z-axis direction. Although FIG. 1 shows the single nanostructure 201*a* extending in the z-axis direction, it may also be possible to form a plurality of nanostructures such that they extend in the z-axis direction.

The remaining nanostructures 201*b*, 201*c*, 201*d*, and 201*e*, excluding the nanostructure 201*a*, are positioned to be symmetrical based on the nanostructure 201*a*. That is, the nanostructure 201*b* is positioned to be symmetrical to the nanostructure 201*d* based on the nanostructure 201*a*, and the nanostructure 201*c* is positioned to be symmetrical to the nanostructure 201*e* based on the nanostructure 201*a*. Accordingly, the nanobundle 20 has a regular configuration, so it has good field emission.

As shown in FIG. 2, the diameter (D) of the opening 501 is larger than the diameter (d) of the nanostructure 201*a*. That is, the diameter (D) of the opening 501 may be ten times larger than the diameter (d) of the nanostructure 201*a*. In this case, the nanostructure 201*a* may be formed as a bundle at the opening 501. That is, the nanobundle 20 is formed in consideration of the relative size difference between the diameter (D) of the opening 501 and the diameter (d) of the nanostructure 201*a*.

As shown in FIG. 2, a ratio of the height (H) of the nanostructure 201*a* to the diameter (d) of the nanostructure 201*a* is 10 or larger. Thus, the field emission device 100 as shown in FIG. 1 can be manufactured with high field emission efficiency by using the nanobundle 20 with a large surface area. Here, the diameter (d) of the nanostructure 201*a* refers to a length obtained by cutting the nanostructure 201*a* in a direction parallel to the surface 101 of the substrate 10, and the height (H) of the nanostructure 201*a* refers to a length obtained by cutting the nanostructure 201*a* in a direction perpendicular to the surface 101 of the substrate 10.

As shown in FIG. 2, neighboring nanostructures 201*a*, 201*d*, and 201*e* form angles θ1 and θ2 therebetween. Here, the angles θ1 and θ2 may be within the range of 20° to 60°. If the angles θ1 and θ2 are smaller than 20° or larger than 60°, the field emission efficiency may somewhat deteriorate. The angles θ1 and θ2 may be substantially the same. Accordingly, nanobundles 20 with the regular configuration can be formed.

The nanostructures 201*a*, 201*b*, 201*c*, 201*d*, and 201*e* and the surface 101 of the substrate 10 may form an angle within the range of 30° to 150° therebetween. If the angle between the nanostructures 201*a*, 201*b*, 201*c*, 201*d*, and 201*e* and the surface 101 of the substrate 10 is smaller than 30° or larger than 150°, the nanostructures 201*a*, 201*b*, 201*c*, 201*d*, and 201*e* would have a configuration of almost lying down on the substrate 10, degrading the electron emission efficiency of the field emission device 100 as shown in FIG. 1. Thus, by maintaining the angle between the nanostructures 201*a*, 201*b*, 201*c*, 201*d*, and 201*e* and the surface 101 of the substrate 10 within the above-mentioned range, the nanostructures 201*a*, 201*b*, 201*c*, 201*d*, and 201*e* have a spatially well-distributed structure.

As shown in FIG. 2, the nanostructures 201*a*, 201*b*, 201*c*, 201*d*, and 201*e* may grow from the seed layer 40. In this case, the seed layer 40 and the structures 201*a*, 201*b*, 201*c*, 201*d*, and 201*e* may contain the same material.

Figure 3:
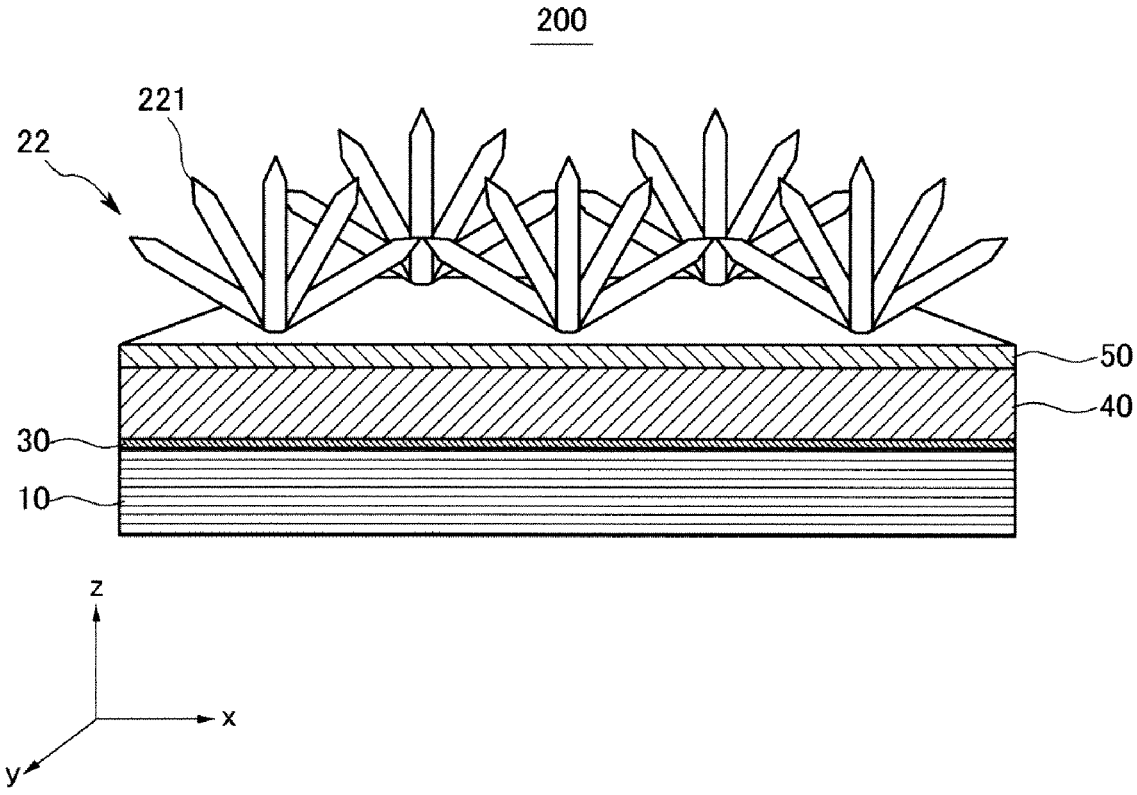
FIG. 3 is a schematic perspective view showing a field emission device according to a second embodiment of the present invention.

FIG. 3 is a schematic perspective view showing a field emission device 200 according to a second embodiment of the present invention. The field emission device 200 as shown in FIG. 3 is similar to the field emission device 100 as shown in FIG. 1, except for nanostructures 221 included in a nanobundle 22, so the same reference numerals are used for the same elements and detailed descriptions thereof will be omitted.

As shown in FIG. 3, the nanostructures 221 each with a pointed end are formed on the seed layer 40. Because the ends of the nanostructures 221 have the pointed shape, they can emit electrons well.

Figure 4:
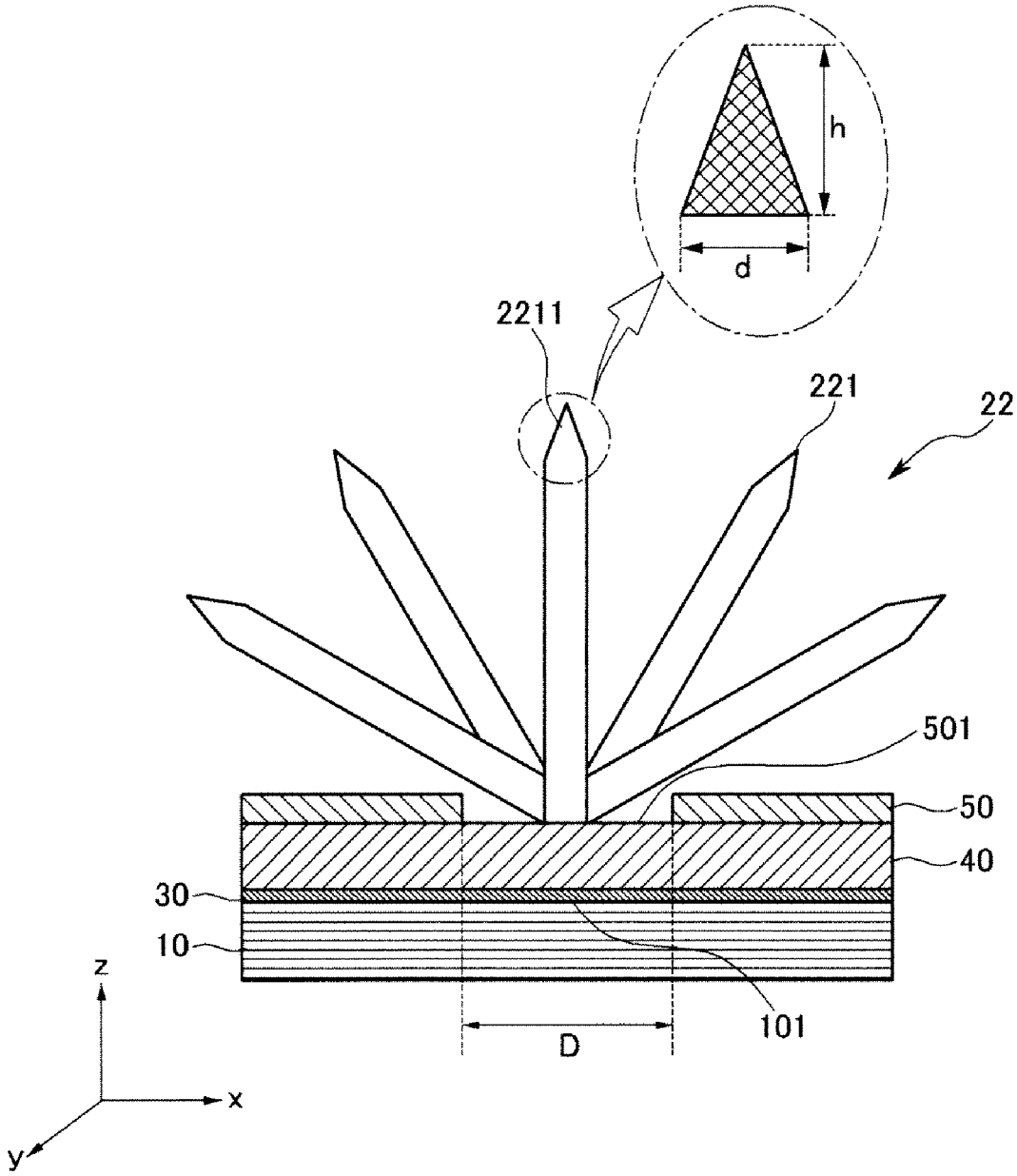
FIG. 4 is an enlarged view of the nanostructure included in the field emission device shown in FIG. 3.

FIG. 4 is a cross-sectional view of the nanobundle 22 taken along line IV-IV in FIG. 3. A circle in FIG. 4 shows an enlarged end portion 2211 of the nanostructure 221 included in the nanobundle 22.

As shown in FIG. 4, the end portion 2211 of the nanostructure 221 has a pointed shape. Here, the end portion 2211 of the nanostructure 221 refers to a region from a boundary point at which the diameter of the nanostructure 221, which is maintained to be substantially the same, starts to become smaller to the tip of the nanostructure 221.

The end portion 2211 of the nanostructure 221 has the shape of an isosceles triangle. Here, a ratio of the height (h) to the length (d) of the base length (d) of the isosceles triangle may be 2 to 4. If the ratio of the height (h) to the base length (d) of the isosceles triangle is smaller than 2, the electron emission efficiency may be somewhat deteriorated. Further, it is difficult to fabricate a nanostructure with a structure in which the ratio of the height (h) to the base length (d) of the isosceles triangle is larger than 4. Owing to the configuration of the isosceles triangle, electrons can be emitted well from the end portion 2211 of the nanostructure 221.

Figure 5:
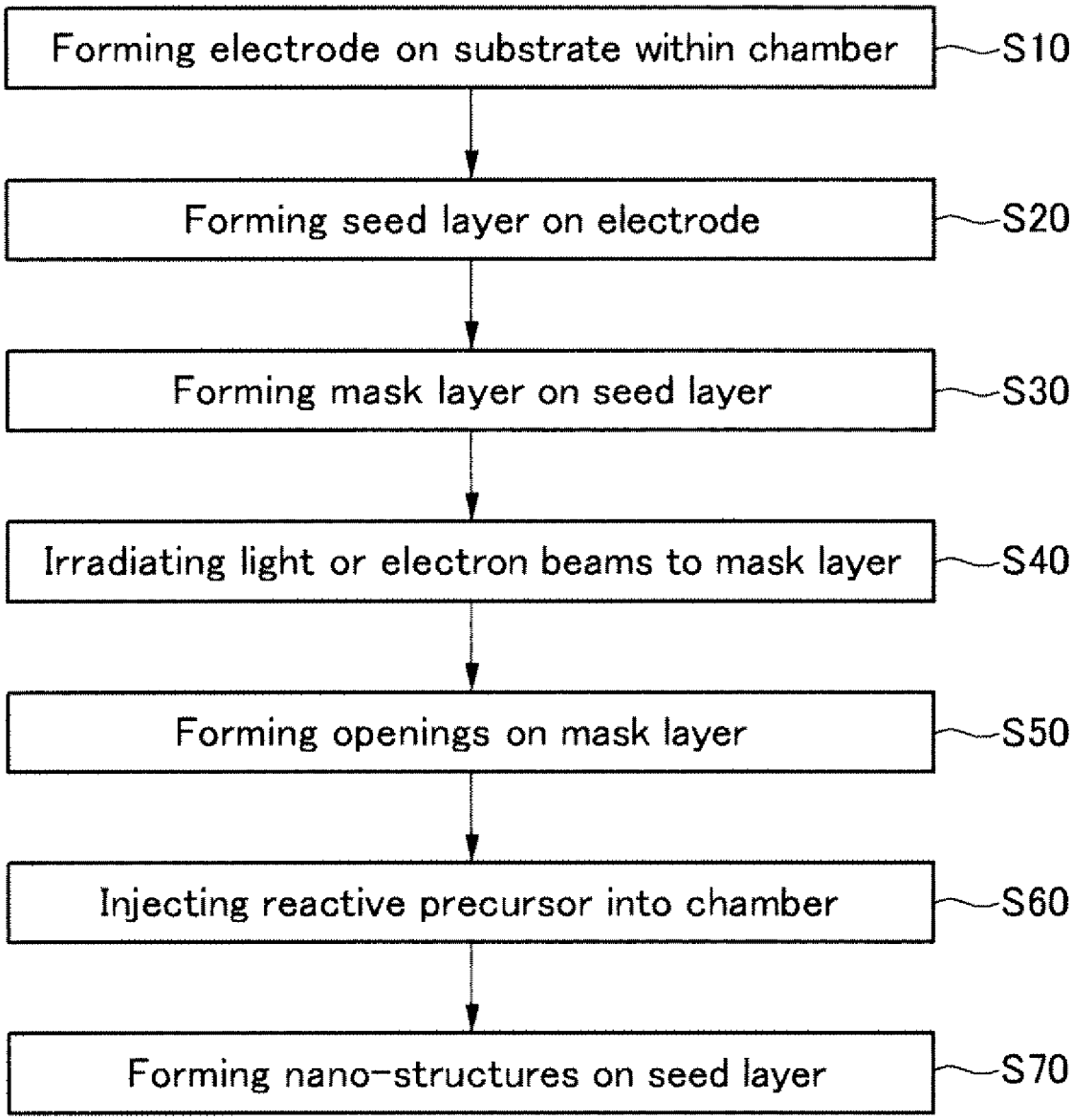
FIG. 5 is a flow chart schematically showing a method for manufacturing the field emission device of FIG. 1.

A method for manufacturing the field emission device 100 according to the first embodiment of the present invention will now be described with reference to FIGS. 5 to 12. FIG. 5 is a flow chart illustrating the method of manufacturing the field emission device 100, and FIGS. 6 to 12 sequentially show the process of each step of the field emission device manufacturing method.

FIG. 5 is a flow chart schematically showing the method for manufacturing the field emission device 100 of FIG. 1 according to the first embodiment of the present invention.

As shown in FIG. 5, the electrode 30 is formed on the substrate 10 positioned within a chamber (not shown) in step S10. The substrate 10 is cleaned so that no impurities exist on its surface, and then dried. As the material of the substrate 10, glass or an organic material may be used. A base material used for forming an electrode is prepared and deposited on the substrate 10, to thus form the electrode 30 on the substrate 10.

Figure 6:
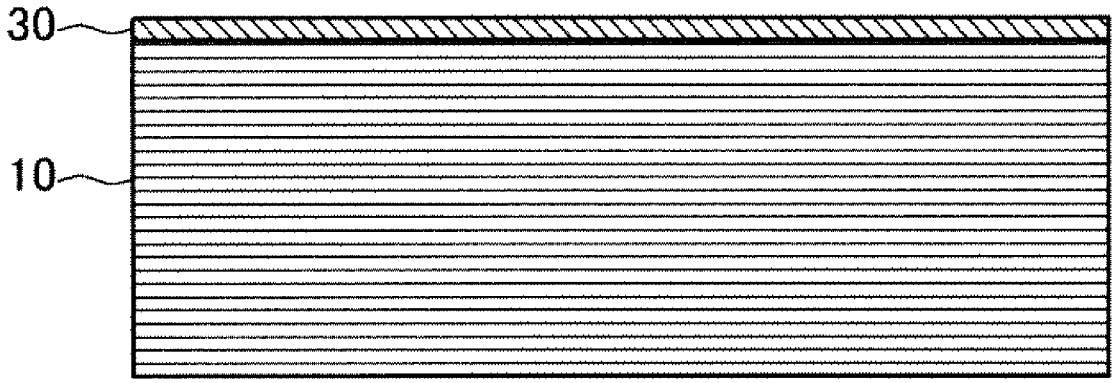
FIGS. 6 to 12 are views sequentially showing each stage of the method for manufacturing the field emission device of FIG. 5.

FIG. 6 schematically shows step S10 of FIG. 5. As shown in FIG. 6, after the substrate 10 is prepared, the electrode 30 is formed on the substrate 10 through a depositing method or the like. The electrode 30 is electrically insulated with the exterior by the substrate 10.

Next, in step S20 of FIG. 5, the seed layer 40 is formed on the electrode 30. The seed layer 40 may be deposited to be formed on the electrode 30. As a material of the seed layer 40, zinc oxide may be used. The seed layer 40 may be deposited on the substrate 10 by using chemical vapor deposition (CVD), metal organic chemical vapor deposition (MOCVD), sputtering, electron beam evaporation, thermal evaporation, pulsed laser deposition, molecular beam epitaxy, chemical beam evaporation, or hydrothermal synthesis.

Figure 7:
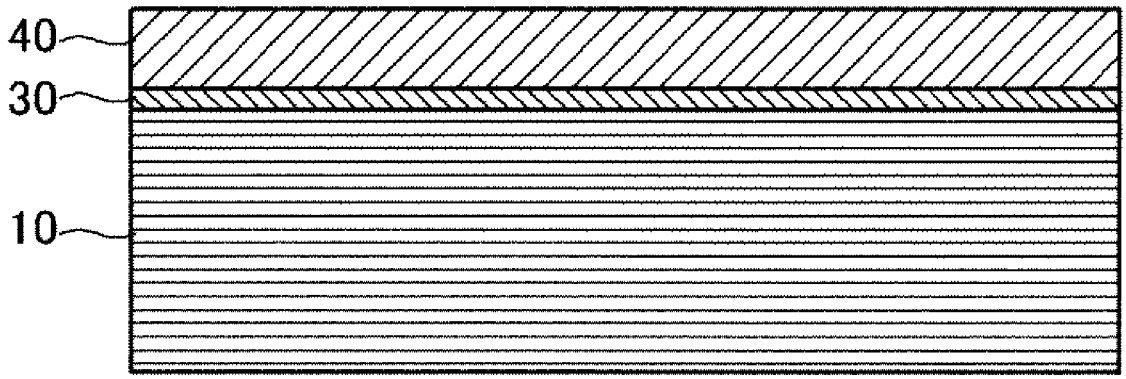

FIG. 7 sequentially shows step S20 of FIG. 5. As shown in FIG. 7, the seed layer 40 made of zinc oxide is formed on the electrode 30. If the nanostructure 201 is properly formed on the electrode 30, there is no need to form the seed layer 40. Thus, step S20 may be omitted.

Thereafter, in step S30 of FIG. 5, the mask layer 50 is formed on the seed layer 40. The mask layer 50 is formed on the seed layer 40 to make the nanostructures 201 selectively grow.

Figure 8:
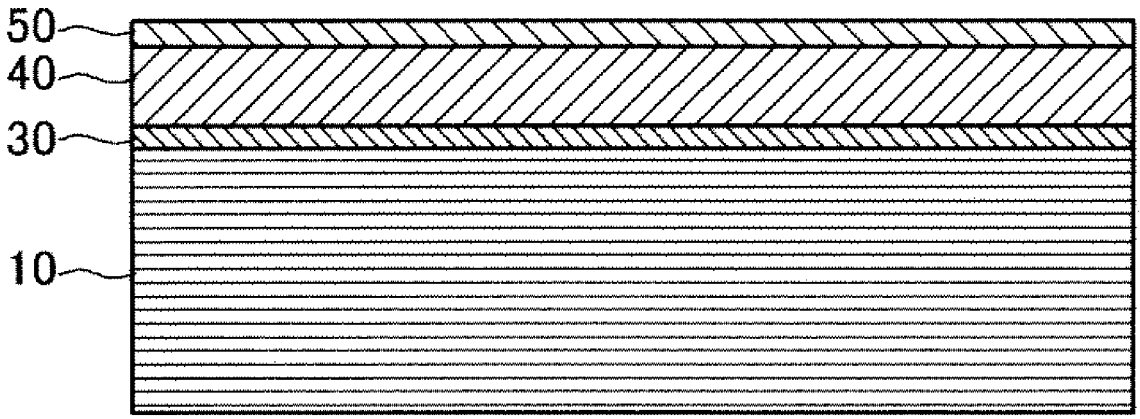

FIG. 8 schematically shows step S30 of FIG. 5. As shown in FIG. 8, the mask layer 50 is attached on the seed layer 40. By coating the mask layer 50 on the seed layer 40, a desired pattern can be formed. For the mask layer 50, a photosensitive resin, for example a photoresist layer, may be used.

Subsequently, in step S40 of FIG. 5, light or electron beams are irradiated to the mask layer 50. Accordingly, a pattern may be formed on the mask layer 50.

Figure 9:
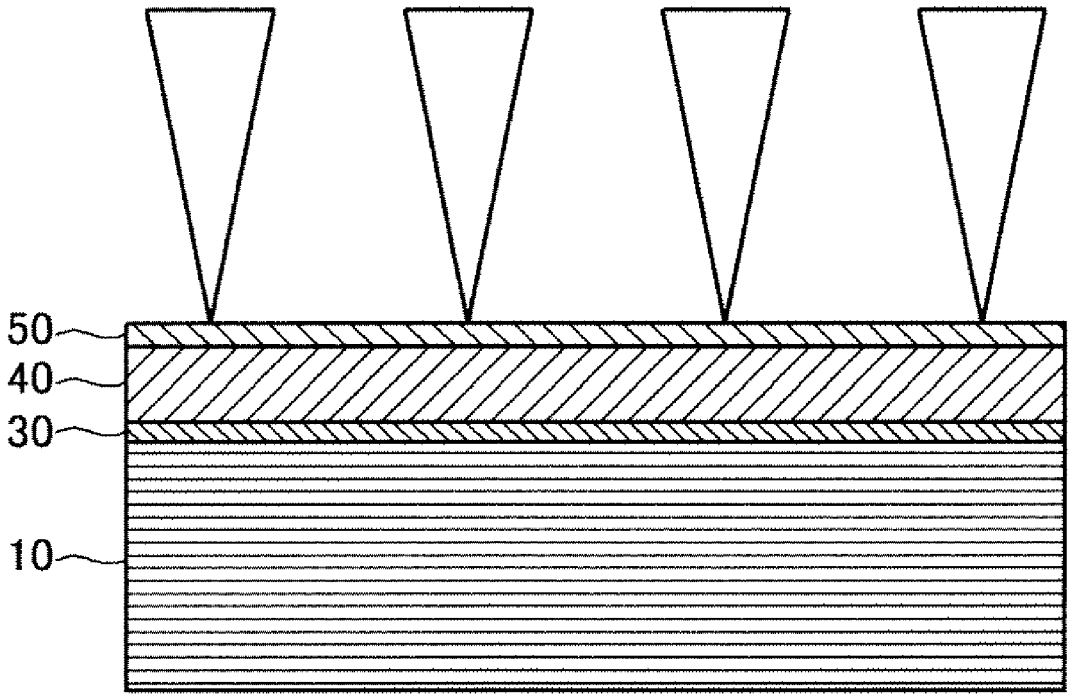

FIG. 9 schematically shows step S40 of FIG. 5. For example, as shown in FIG. 9, light or electron beams are irradiated to the mask layer 50. The irradiated portions of the mask layer 50 may be etched so as to be removed.

In step S50 of FIG. 5, the opening 501 is formed on the mask layer 50. Only the portions of the mask layer 50 to which light or electron beams have been irradiated are stripped (parted) to form the plurality of openings 501 to thus fabricate the patterned mask layer 50.

Figure 10:
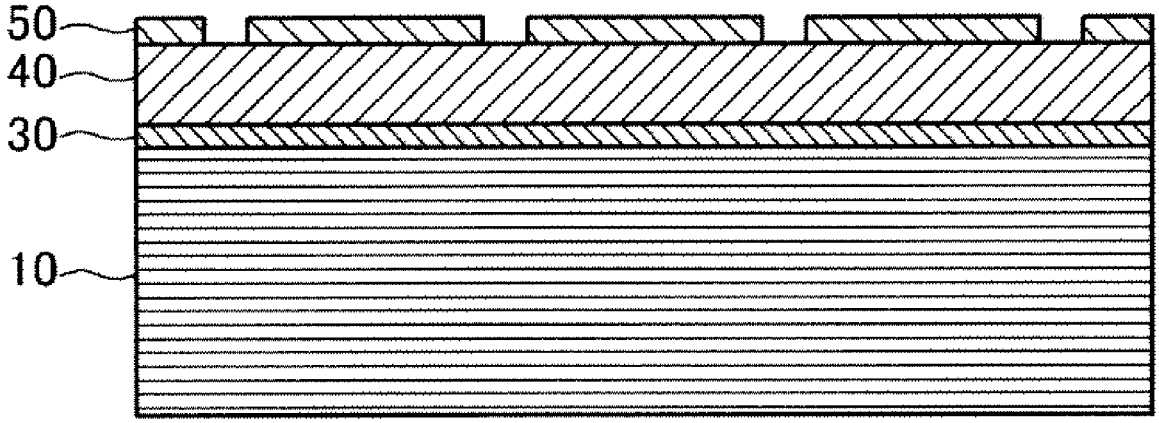

FIG. 10 schematically shows step S50 of FIG. 5. When the mask layer 50 is developed, the light or electron beam-irradiated portions are stripped to form the openings 510, exposing the seed layer 40. The mask layer 50 may be etched by using a physical etching method using plasma or a chemical etching method using a chemical solution.

Then, in step S60 of FIG. 5, a reactive precursor is injected into the chamber. As the reactive precursor, an aqueous solution that is appropriate for the material of the nanostructures 201 to be grown may be used.

Figure 11:
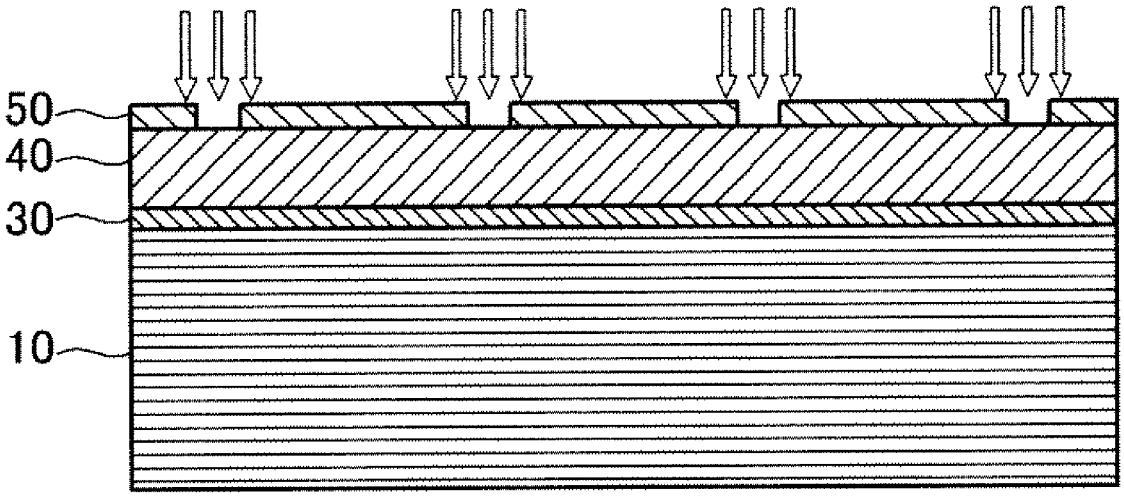

FIG. 11 schematically shows step S60 of FIG. 5. As the reactive precursor is in contact with the seed layer 40 via the openings 501, nanostructures 201 grow from the seed layer 40.

Thereafter, in step S70 of FIG. 5, the nanobundle 20 including the plurality of nanostructures 201 is formed. Accordingly, the field emission device 100 (as shown in FIG. 12) can be manufactured.

Figure 12:
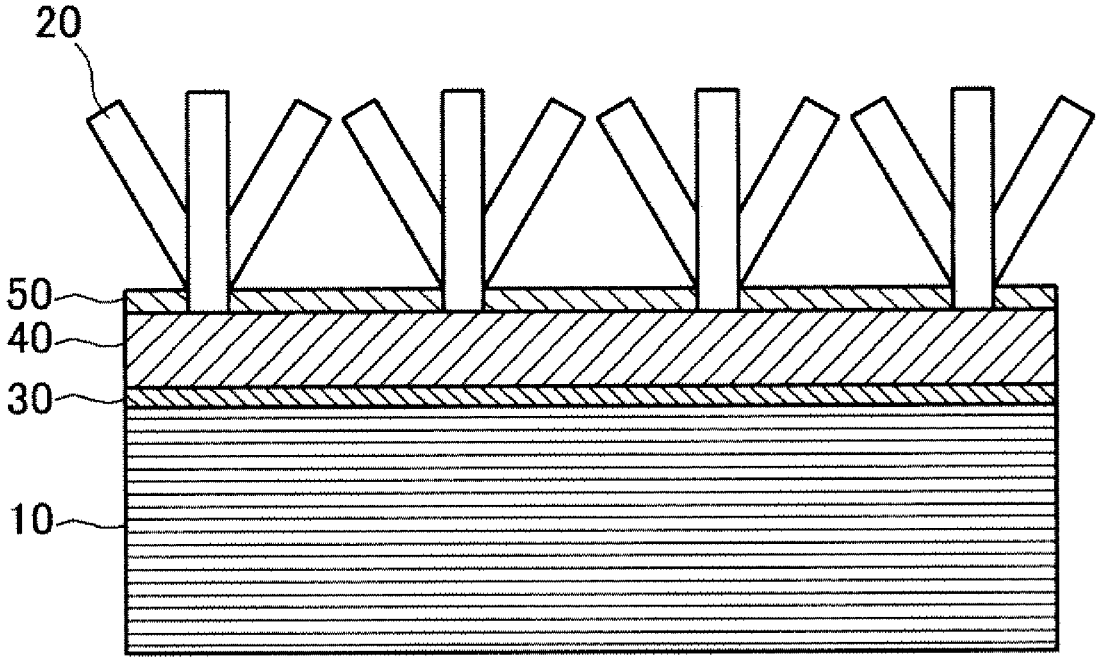

FIG. 12 schematically shows step S70 of FIG. 5. The nanostructures 201 are formed on the seed layer 40 exposed via the openings 501. The nanostructures 201 grow only on the openings due to the mask layer 50.

If the nanostructures 201 are fabricated with zinc oxide, zinc nitride, zinc acetate, their derivatives, hexamethyltetramine, or ammonium hydroixdeis used as the reactive precursor. The solution containing the reactive precursor of a certain concentration is injected into the chamber. Then, the reactive precursor reacts with the seed layer 40 to make the nanostructures made of zinc oxide grow.

The shape of the nanostructures 20 may be changed according to reaction conditions within the chamber. That is, the length or diameter of the nanostructures 201 may be changed by controlling the temperature or pressure within the chamber or adjusting the amount of the reactive precursor. For example, the diameter of the nanostructures may be adjusted to be 100 nm by using 0.1M of zinc nitrate and 0.1M of hexamethyltetramine. In addition, the diameter of the nanostructures may be adjusted to be 100 nm by using 0.025M of zinc nitrate and 0.025M of hexamethyltetramine The nanostructures 201 grow only through the openings 501 while exhibiting the selective growth characteristics. Crystal growth occurs from the seed layer 40 that serves to help the nanostructures 201 grow. The nanostructures 201 do not grow from the mask layer 50 that does not serve for nucleation. The growth direction of the nanostructures 201 and that of the seed layer 40 are substantially the same. Thus, the growth direction of the nanostructures 201 may be adjusted by adjusting the crystal growth direction of the seed layer 40. Accordingly, spatial arrangement of the nanostructures 20 can be adjusted.

Figure 13:
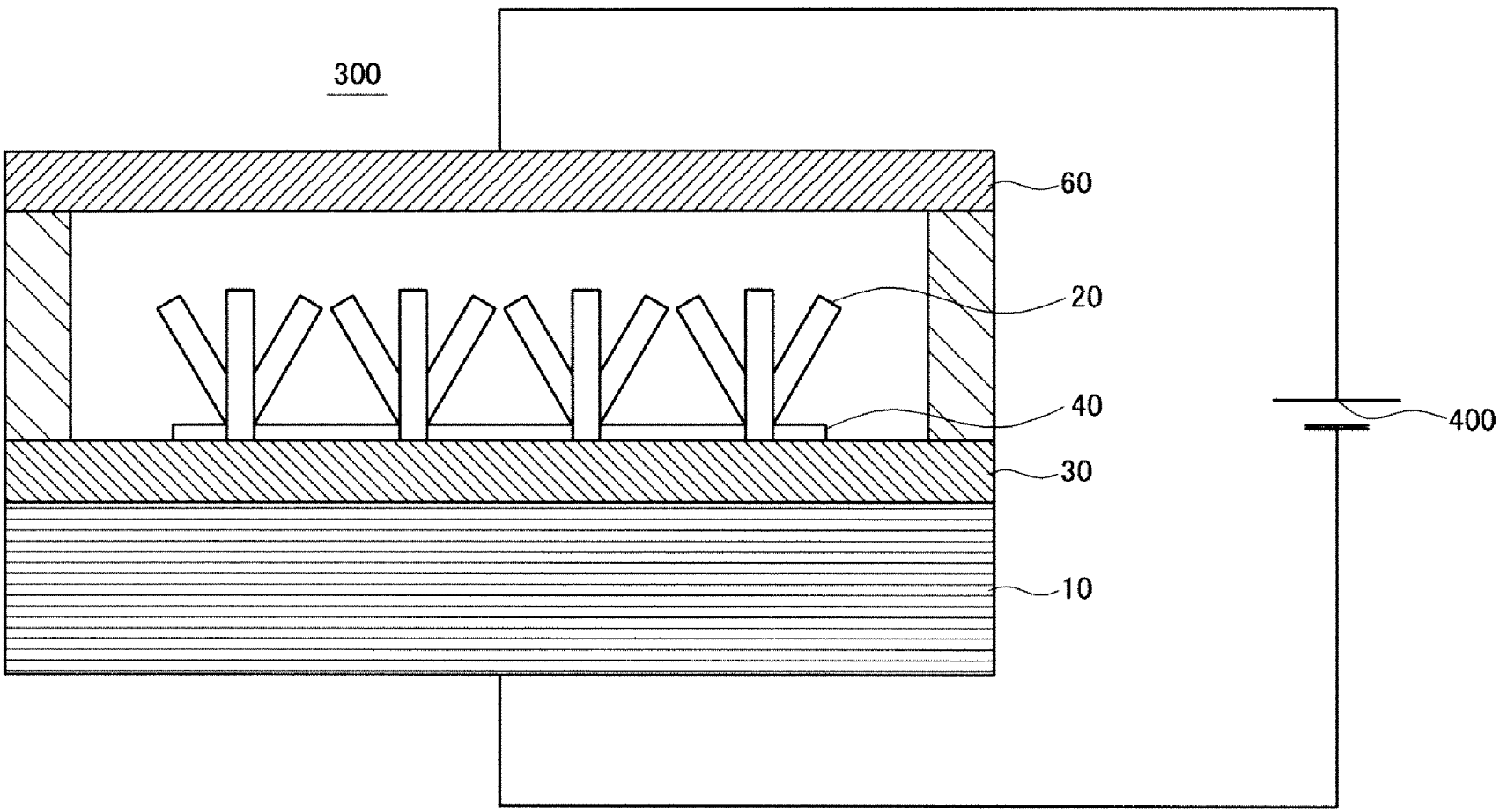
FIG. 13 is a view schematically showing an operation state of the field emission device.

FIG. 13 is a view schematically showing an operation state of the field emission device 300. Since a structure of the field emission device 300 is similar to that of the field emission of device of FIG. 1, like elements are referred to as like reference numerals and detailed description thereof is omitted.

As shown in FIG. 13, the interior of the field emission device 300 is vacuumized, and a power source 400 is connected to the electrode 30 and the electrode 60 to induce electric field between the electrode 30 and electrode 60. Then, electrons are emitted from the nanobundle 20, forming an electric field. The field emission device 300 manufactured by using the above-described method can be applied to various equipment that require an electron emission source.

Figure 14:
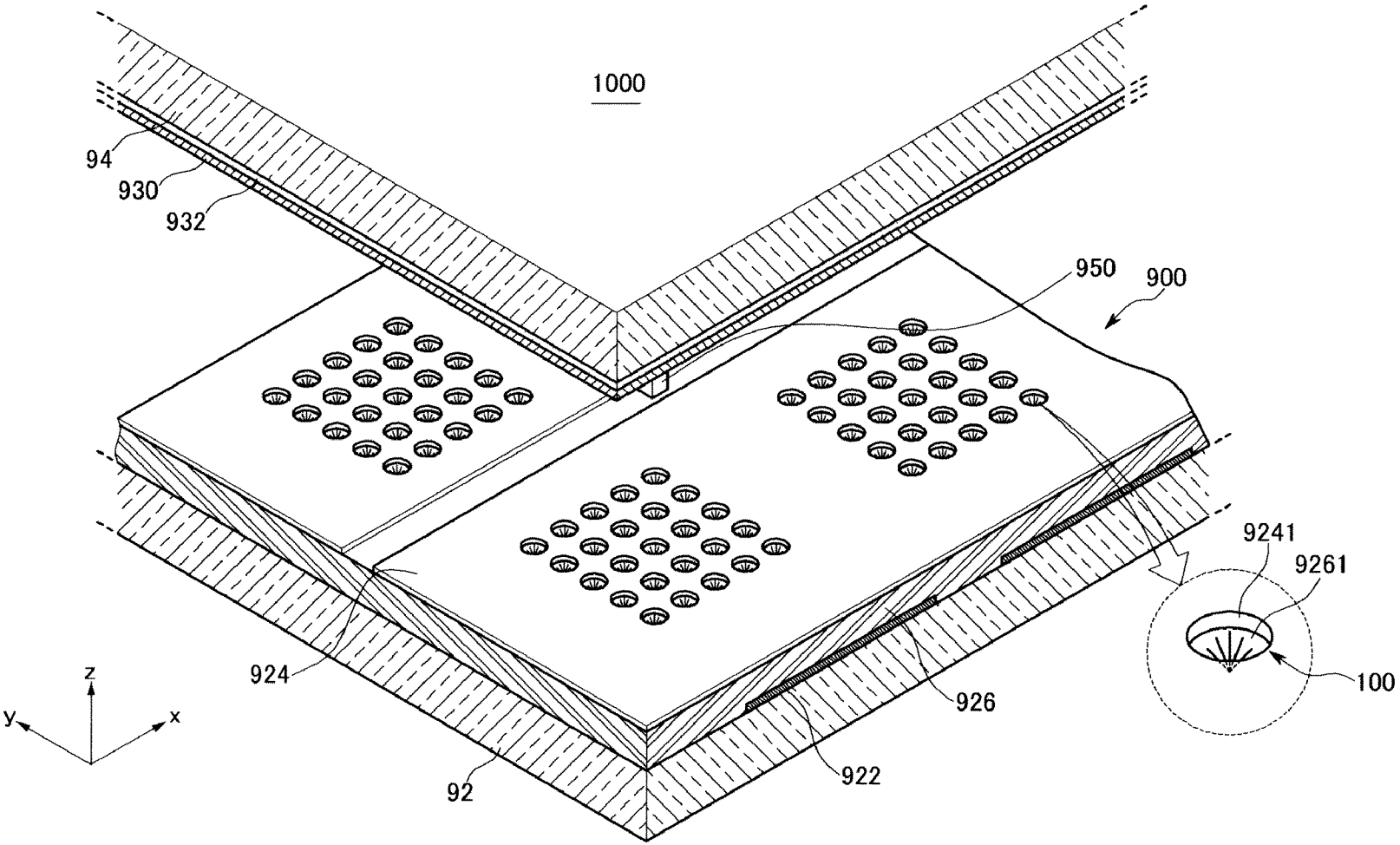
FIG. 14 is a schematic exploded view of a field emission display device including the field emission device of FIG. 1.

FIG. 14 is a schematic exploded view of a field emission display device 1000 including the field emission device 100 of FIG. 1. The circle in FIG. 14 shows the field emission device 100 in a magnified form. The field emission display device 1000 is used for a display device.

As shown in FIG. 14, the field emission display device 1000 includes first and second substrates 92 and 94 facing each other. The space between the first and second substrates 92 and 94 is under vacuum of approximately $10^{-6}$ torr, and is vacuumized to be hermetically sealed. In order to form the space between the first and second substrates 92 and 94, a spacer 950 is disposed therebetween. The first and second substrates 92 and 94 may be fabricated with transparent glass, for example.

An electron emission element 900 includes cathode electrodes 922, the field emission device 100, and gate electrodes 924. An insulating layer 926 is interposed between the cathode electrodes 922 and the gate electrodes 924 to prevent a short-circuit between the cathode electrodes 922 and the gate electrodes 924.

The cathode electrodes 922 are disposed on the first substrate such that they are spaced apart from each other. The cathode electrodes 922 may serve as data electrodes upon receiving a data driving voltage. The field emission device 100 is positioned at light emission pixels where the cathode electrodes 922 and the gate electrodes 924 overlap. The field emission device 100 is electrically connected to the cathode electrodes 922.

As shown in the circle in FIG. 14, openings 9261 and 9241 are formed at the insulating layer 926 and at the gate electrodes 924, respectively, to allow electrons emitted from the field emission device 100 to pass therethrough. The electrons are emitted from the field emission device 100 due to a difference of voltages applied to the cathode electrodes 922 and the gate electrodes 924.

A phosphor layer 932 and an anode electrode 930 are positioned on the second substrate 94. Because a high voltage is applied to the anode electrode 930, the electrons emitted from the field emission device 100 are attracted to collide at a high speed with the phosphor layer 932. Accordingly, visible rays are generated from the phosphor layer 932 and externally outputted through the second substrate 94. The phosphor layer 932 has a white color, so it may output white light. Alternatively, the phosphor layer 932 may be formed to have red (R), green (G), and blue (B) colors to output light of various other colors.

The embodiments of the present invention will now be described in more detail through experimental examples. The experimental examples are merely illustrative of the present invention, and the present invention is not limited thereto.

EXPERIMENTAL EXAMPLE 1

An indium tin oxide (ITO) thin film was formed as an electrode on the substrate. The seed layer was formed on the ITO thin film. The seed layer that was made of zinc oxide was formed on the substrate made of glass by using metal organic chemical vapor deposition (MOCVD). Next, the mask layer was formed on the seed layer.

In order to pattern the mask layer, a polymethyl methacrylate (PMMA) was used as a e-beam resist. After the e-beam resist was formed on the seed layer through spin-coating, it was baked. The e-beam resist was exposed to electron beam with a certain pattern.

Then, the e-beam resist was etched with a developer (developing solution) to remove portions that had been exposed to electron beam. As a result, portions of the seed layer were exposed via the openings formed on the mask layer. The seed layer was exposed with a regular pattern.

Figure 15:
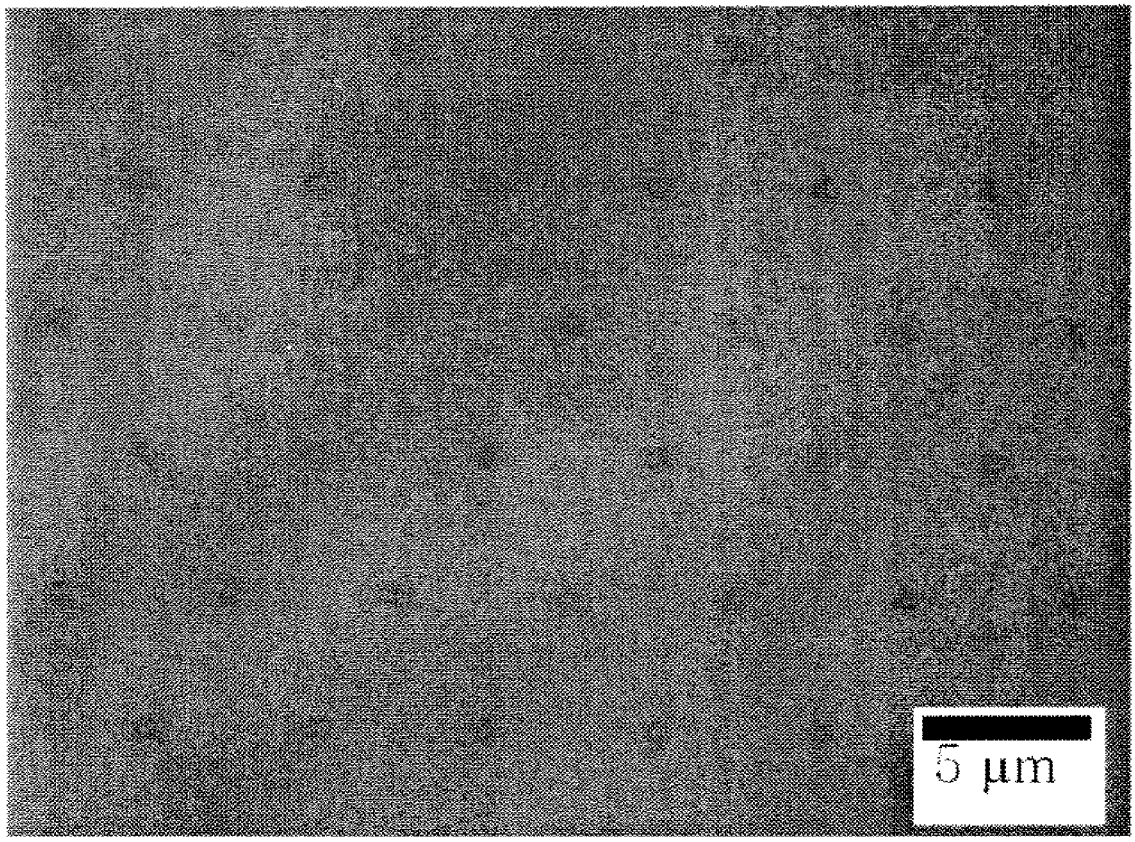
FIG. 15 is a scanning electron microscope photograph of a mask layer included in the field emission device manufactured according to Experimental Example 1 according to an embodiment of the present invention.

FIG. 15 is a scanning electron microscope photograph of the mask layer included in the field emission device manufactured according to Experimental Example 1 according to an embodiment of the present invention. As shown in FIG. 15, the seed layers with a regular pattern were exposed via the openings of the mask layer.

Thereafter, the substrate was loaded into a hydrothermal synthesis reactor and maintained at a temperature of higher than 80° C. for four hours to cause nanorods made of zinc oxide to grow from the exposed seed layer. As a reactive precursor, zinc nitrate and ammonium hydroxide were dissolved in deionized water so as to be used. In this case, the nanostructures with pointed end portions were obtained in the form of bundles. The diameter of the nanostructures was within the range of about tens of nm to hundreds of nm, and the length of the nanostructures was a few μm.

Figure 16:
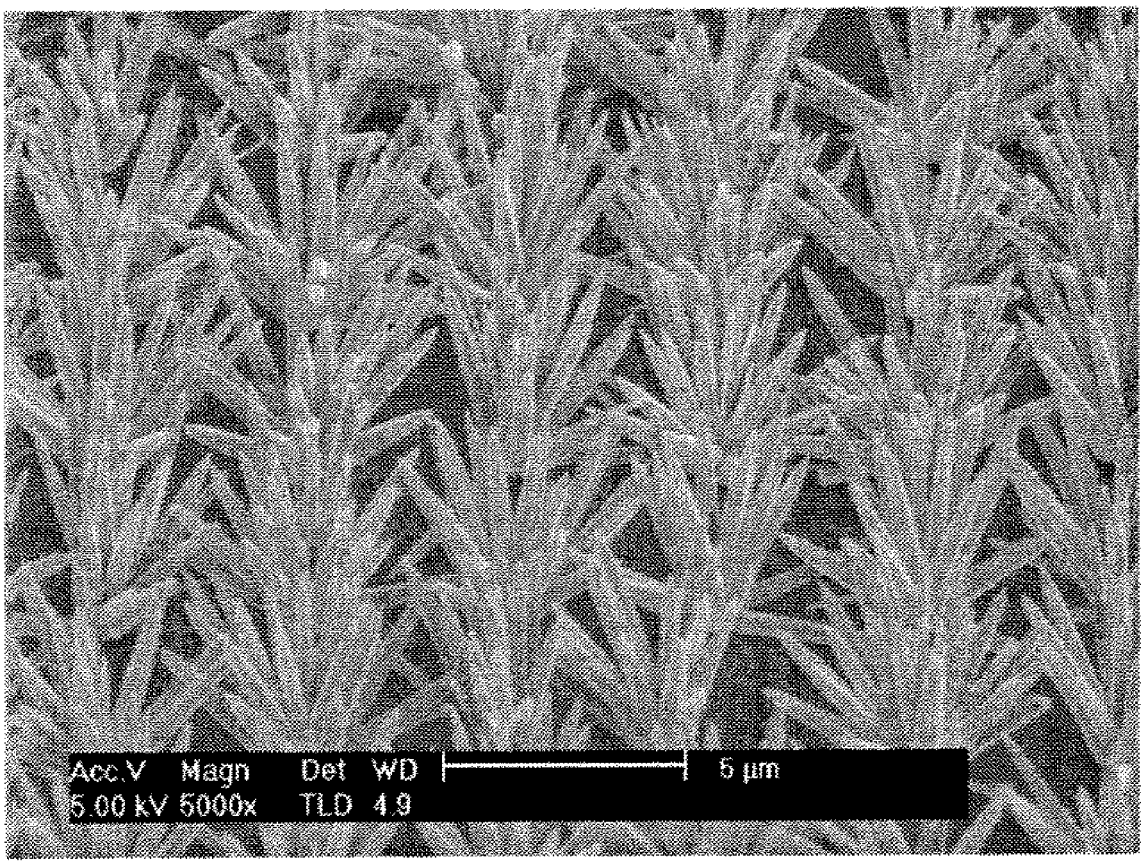
FIGS. 16 and 17 are a stereoscopic scanning electron microscope photograph and a plane scanning electron microscope photograph of nanostructures included in the field emission device manufactured according to Experimental Example 1 according to an embodiment of the present invention.

FIG. 16 is a stereoscopic scanning electron microscope photograph of the nanostructures included in the field emission device manufactured according to Experimental Example 1. As shown in FIG. 16, nanobundles (nanoflowers) made of zinc oxide were generated. The plurality of nanostructures was separately and regularly arranged in one direction.

Figure 17:
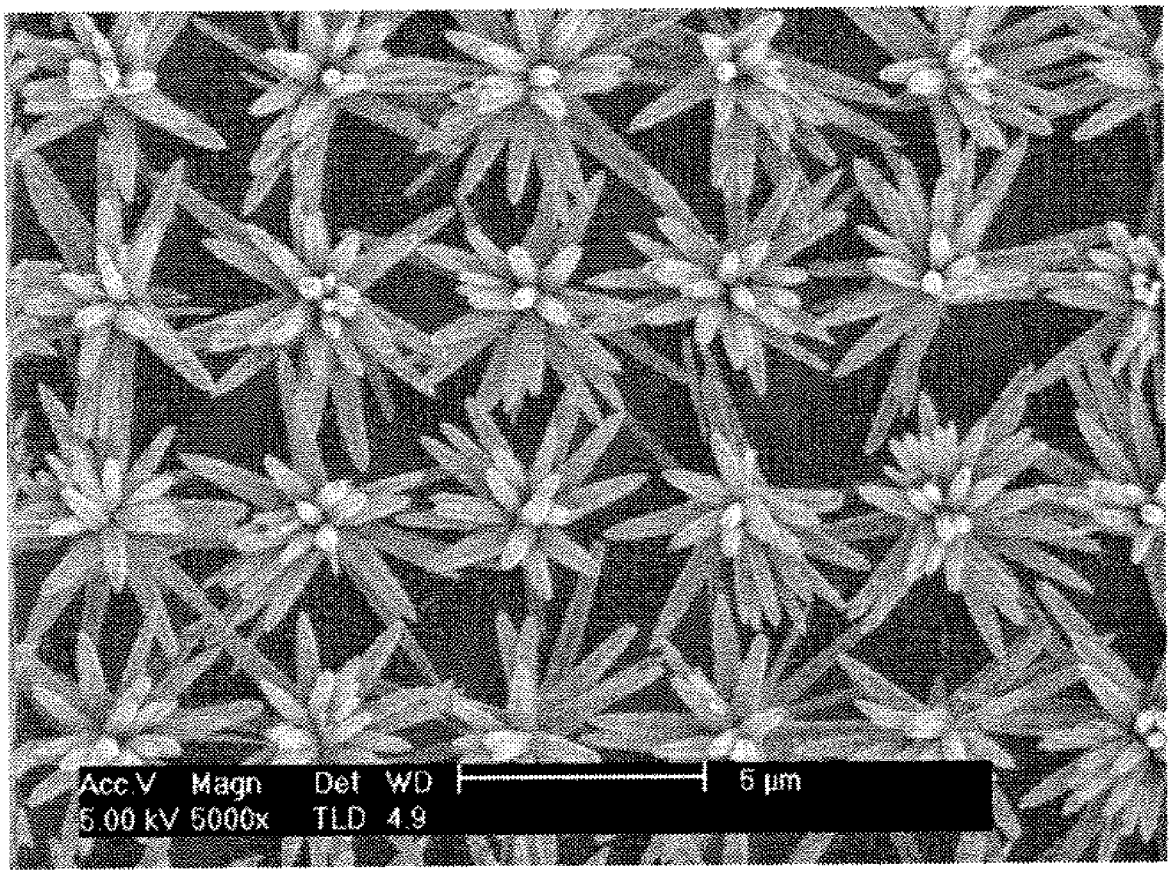

FIG. 17 is a plane scanning electron microscope photograph of the nanostructures included in the field emission device manufactured according to Experimental Example 1. As shown in FIG. 17, the nanostructures are positioned to be spaced apart from each other.

Figure 18:
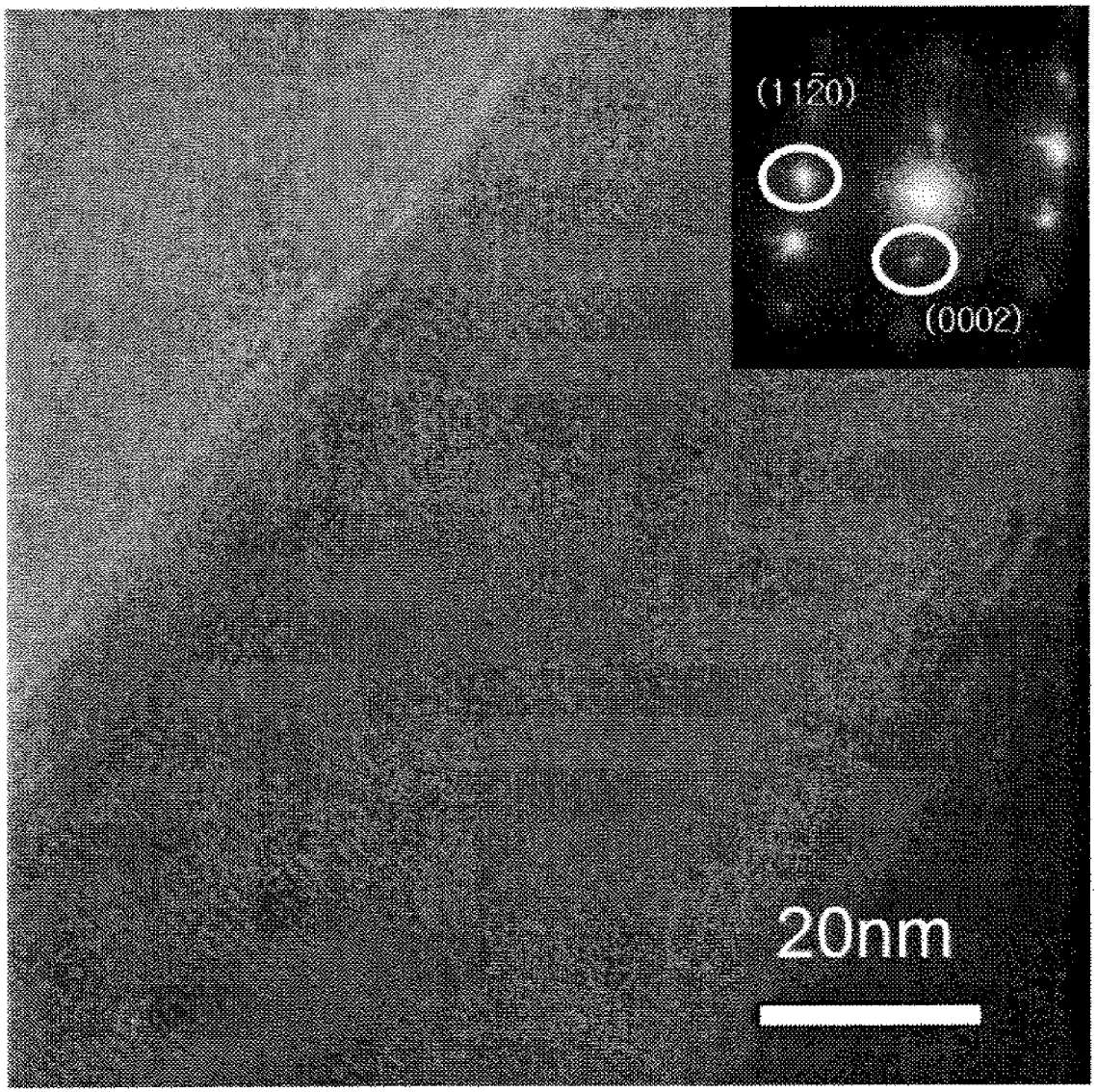
FIG. 18 shows a transmission electron microscope photograph and an electron diffraction pattern of the nanostructures of FIG. 16.

FIG. 18 shows a transmission electron microscope photograph and an electron diffraction pattern of the nanostructures of FIG. 16. In order to take the transmission electron microscope photograph, the nanostructures were separated from the substrate and put on the transmission electron microscope grid, and then a lattice structure of the nanostructures was observed.

As shown in FIG. 18, little point defect or line defect was observed from the nanostructures. Accordingly, it was noted and confirmed that the nanostructures have excellent crystalline characteristics. It was also noted that the nanostructures grew in the direction of [0001] through an electron diffraction pattern.

COMPARATIVE EXAMPLE

For a comparison with Experimental Example 1 of the present invention as described above, nanostructures were grown by using a substrate with only the electrode and the seed layer formed thereon, but without the mask layer. Experimental conditions of the comparative example were the same as those of Experimental Example 1, except that the mask layer was not used.

Figure 19A:
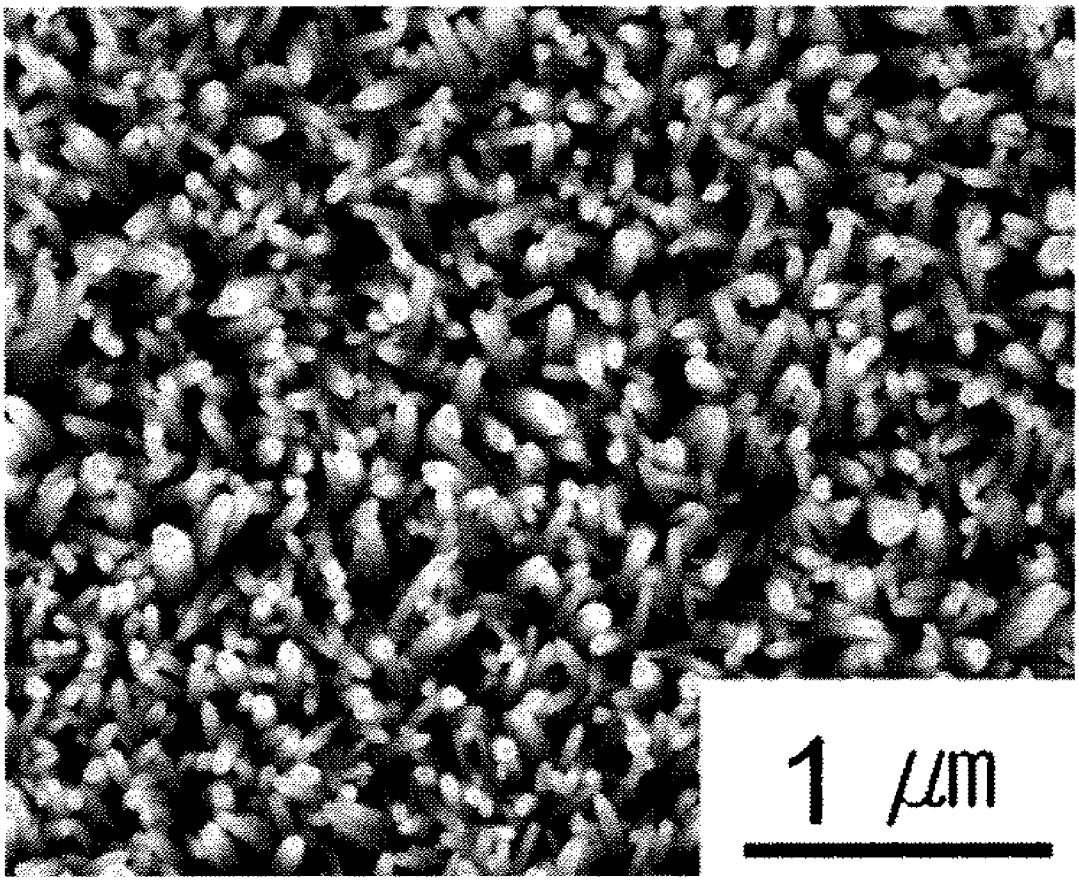
FIGS. 19A and 19B show a stereoscopic scanning electron microscope photograph and a plane scanning electron microscope photograph of the nanostructures included in the field emission device manufactured according to a comparative example, respectively.
Figure 19B:
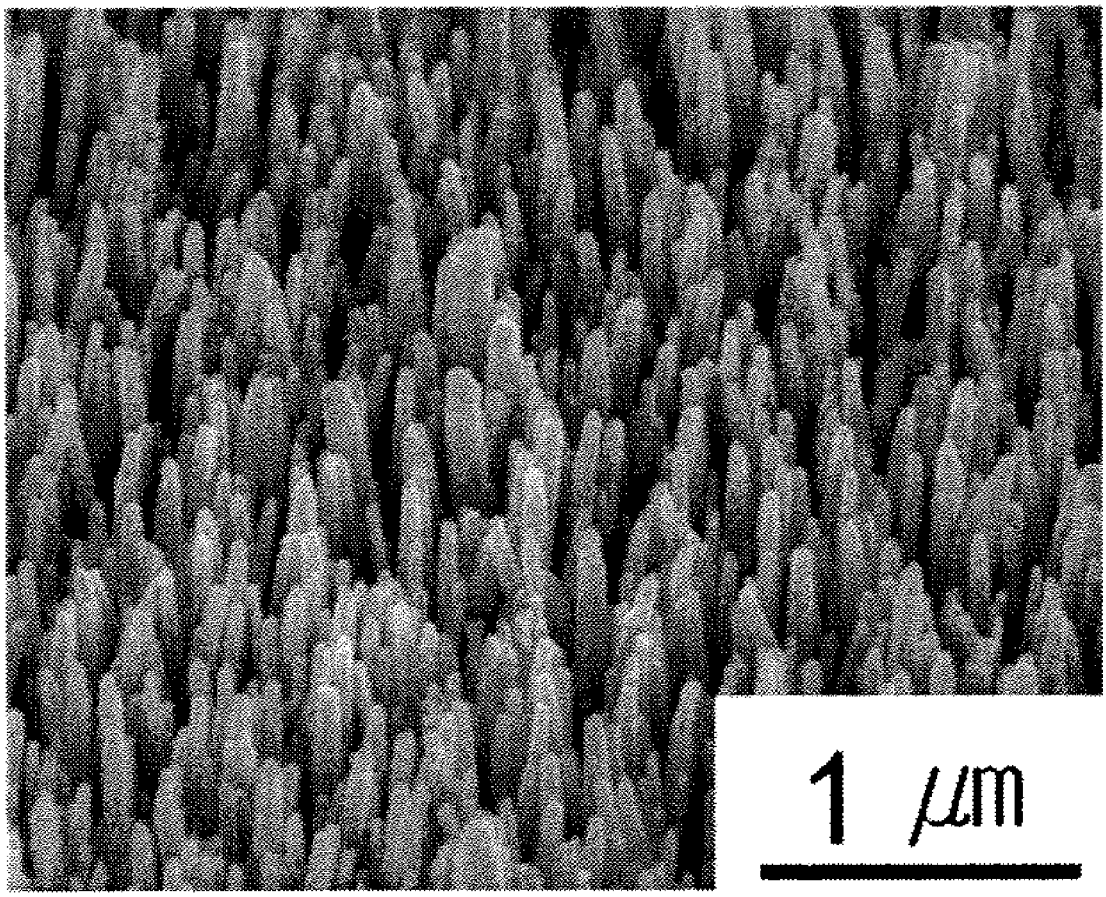

FIGS. 19A and 19B show a stereoscopic scanning electron microscope photograph and a plane scanning electron microscope photograph of the nanostructures included in the field emission device manufactured according to comparative example, respectively.

As shown in FIGS. 19A and 19B, it is noted that the field emission device manufactured without the mask layer has nanostructures of which position, space, and arrangement are not regular but are random. In addition, the nanostructures do not have the bundle form but grew such that they are entirely independently spaced apart from each other, and have the shape of needles.

Experimentation of Electric Field Emission Characteristics of Experimental Example 1 and the Comparative Example The field emission characteristics of the nanostructures included in the electric field emission device manufactured according to Experimental Example 1 and those according to the comparative example were subjected to experimentation and then compared. Field emission current density according to the voltage applied to the nanostructures was measured under a high vacuum of $10^{-6}$ torr, and the electric field emission characteristics were observed.

Figure 20:
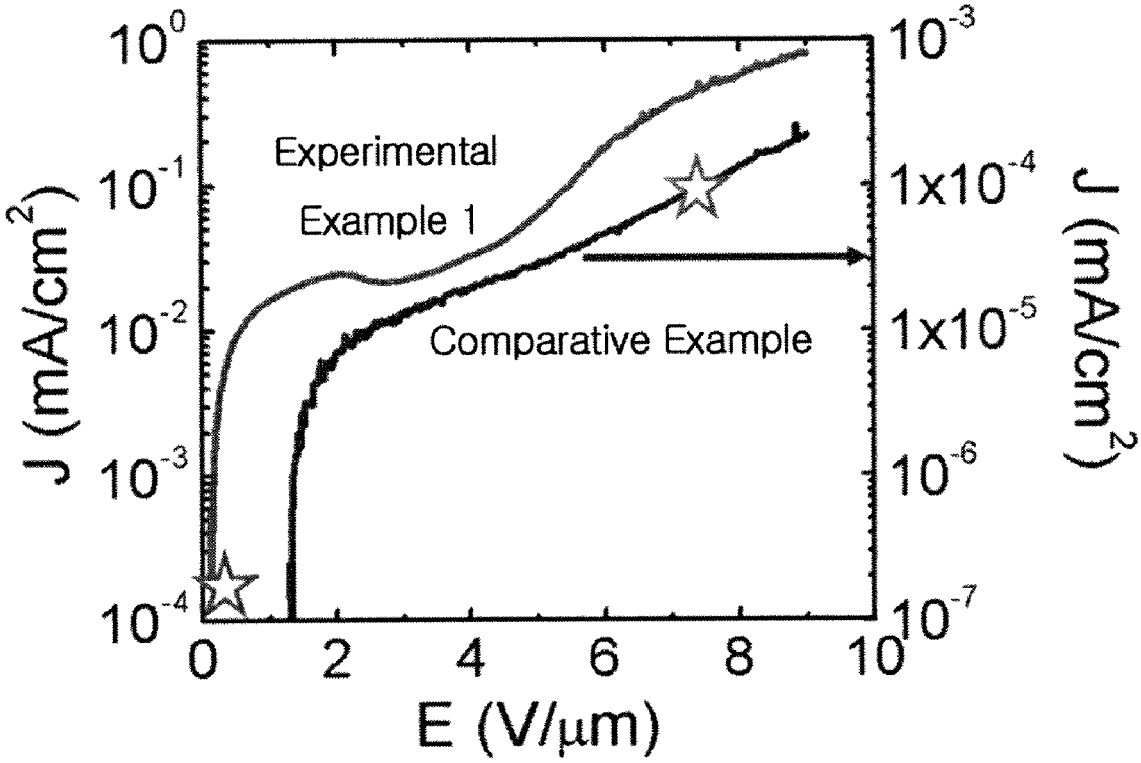
FIG. 20 is a graph showing a change in a field emission current density according to an application of voltage to the nanostructures included in the field emission device manufactured according to Experimental Example 1 and that of the comparative example.

Results of Field Emission Characteristics of Experimental Example 1 and the Comparative Example FIG. 20 is a graph showing a change in the electric field emission current density according to an application of voltage to the nanostructures included in the field emission device manufactured according to Experimental Example 1 and that of the comparative example.

As shown in FIG. 20, it can be noted that the nanostructures whose position was adjusted by virtue of the mask layer have superior electron emission characteristics to that of the nanostructures of the comparative example in which the position of the nanostructures was not adjusted due to the lack of the mask layer. In the case of Experimental Example 1, the electric field required for a flow of a current density of 0.1 $\mu A/cm^2$ or more according to the electron emission was 0.13V/μm, which was significantly lower than 7.6V/μm of the comparative example. When 9.0V/μm was applied as an external electric field to the nanostructures of Experimental Example 1, a current density of 0.8 $mA/cm^2$ was generated.

When current was calculated with the value obtained from a single nanostructure, 9.9 pA of current was generated from the nanostructures of Experimental Example 1. This is equivalent to about 10,000 times $7.4\times10^{-5}$ pA, which is the current generated from a single nanostructure of the comparative example. That is, as noted from Experimental Example 1, in manufacturing the field emission device, its electron emission efficiency can be enhanced by adjusting the position, space, and arrangement of the nanostructures.

Figure 21:
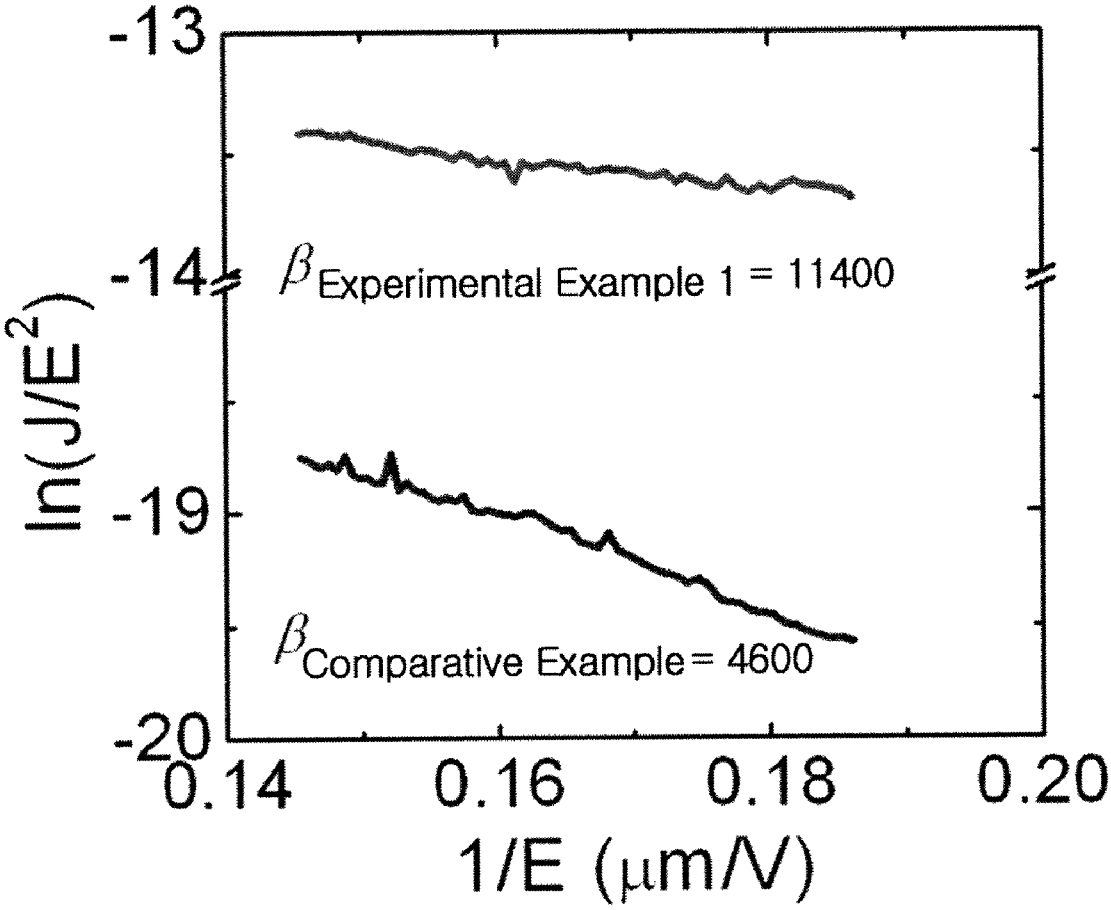
FIG. 21 is a graph showing Fowler-Nordheim current density of the nanostructures included in the field emission devices manufactured according to Experimental Example 1 and the comparative example.

FIG. 21 is a graph showing Fowler-Nordheim current density of the nanostructures included in the field emission devices manufactured according to Experimental Example 1 and the comparative example.

As shown in FIG. 21, the value of a field enhancement factor (β) (or field enhancement coefficient) of the nanostructures of Experimental Example 1 was 11,400, which is quite high. In contrast, the field enhancement factor of the nanostructures of the Comparative Example was 4500, which is relatively small. That is, it can be noted that the field enhancement factor of the nanostructures of Experimental Example 1 whose position, space, and arrangement were adjusted is much larger than that of the nanostructures of the comparative example. Consequently, it was verified that the nanostructures of Experimental Example 1 have excellent electric field emission characteristics and thus are appropriate to be used for an electric field emission element.

Experimentation of Field Emission Display Device

The field emission display device was manufactured by using the field emission device of Experimental Example 1. That is, the spacer was installed on one substrate with the nanostructures of FIG. 16 formed thereon, and another substrate with the electrode and the phosphor layer formed thereon was installed on the spacer. Here, a mask layer patterned in an "L" shape was used to form nanostructures in the "L" shape. Next, the interior was hermetically sealed and vacuumized to manufacture the field emission display device. Then, a power source was connected to both substrates of the field emission display device, and a voltage was applied to both substrates.

Results of Experimentation of Field Emission Display Device

Figure 22A:
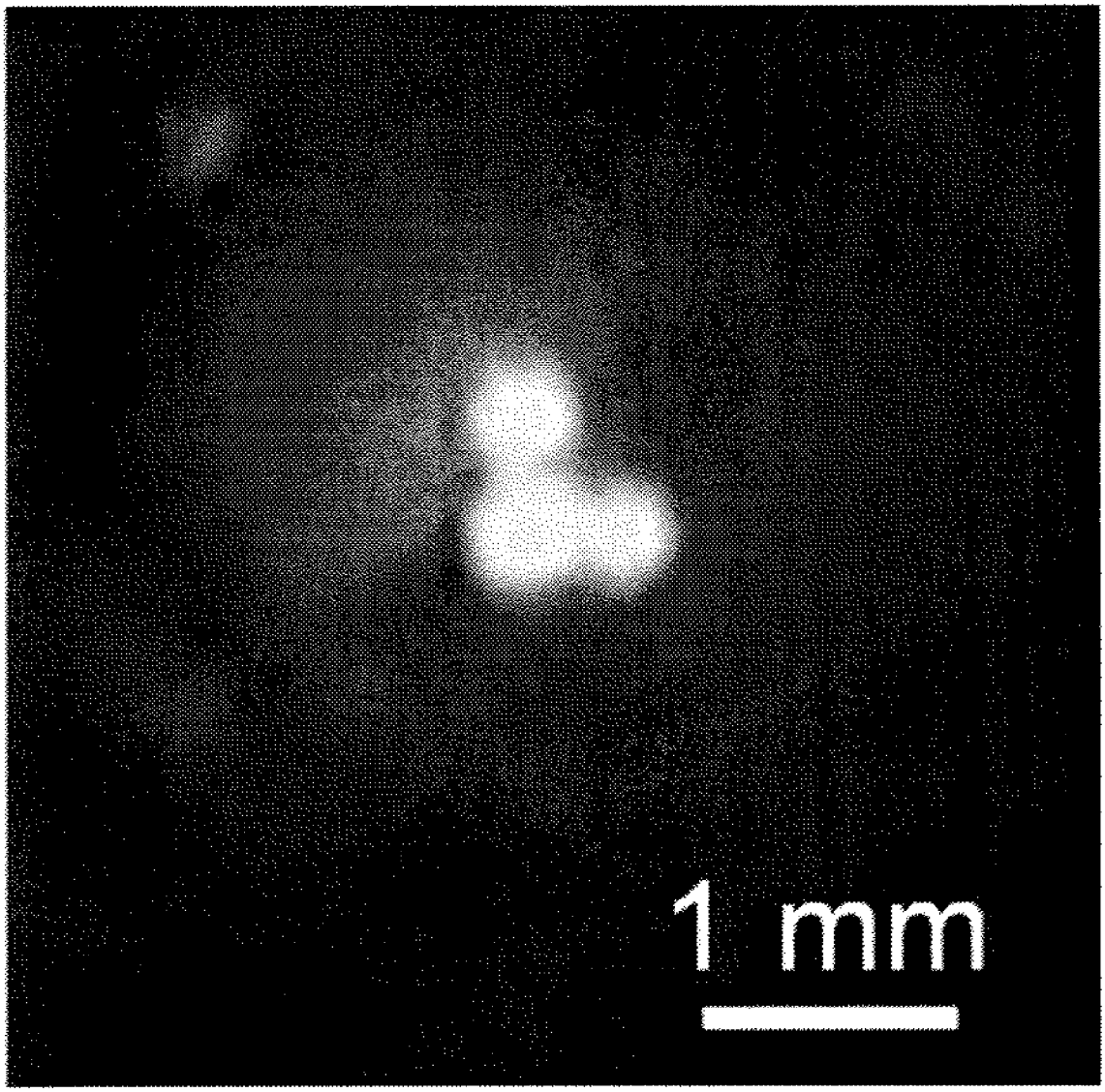
FIGS. 22A and 22B are photographs showing operational states of the nanostructures included in the field emission display device manufactured by using the field emission device of Experimental Example 1 according to an embodiment of the present invention.
Figure 22B:
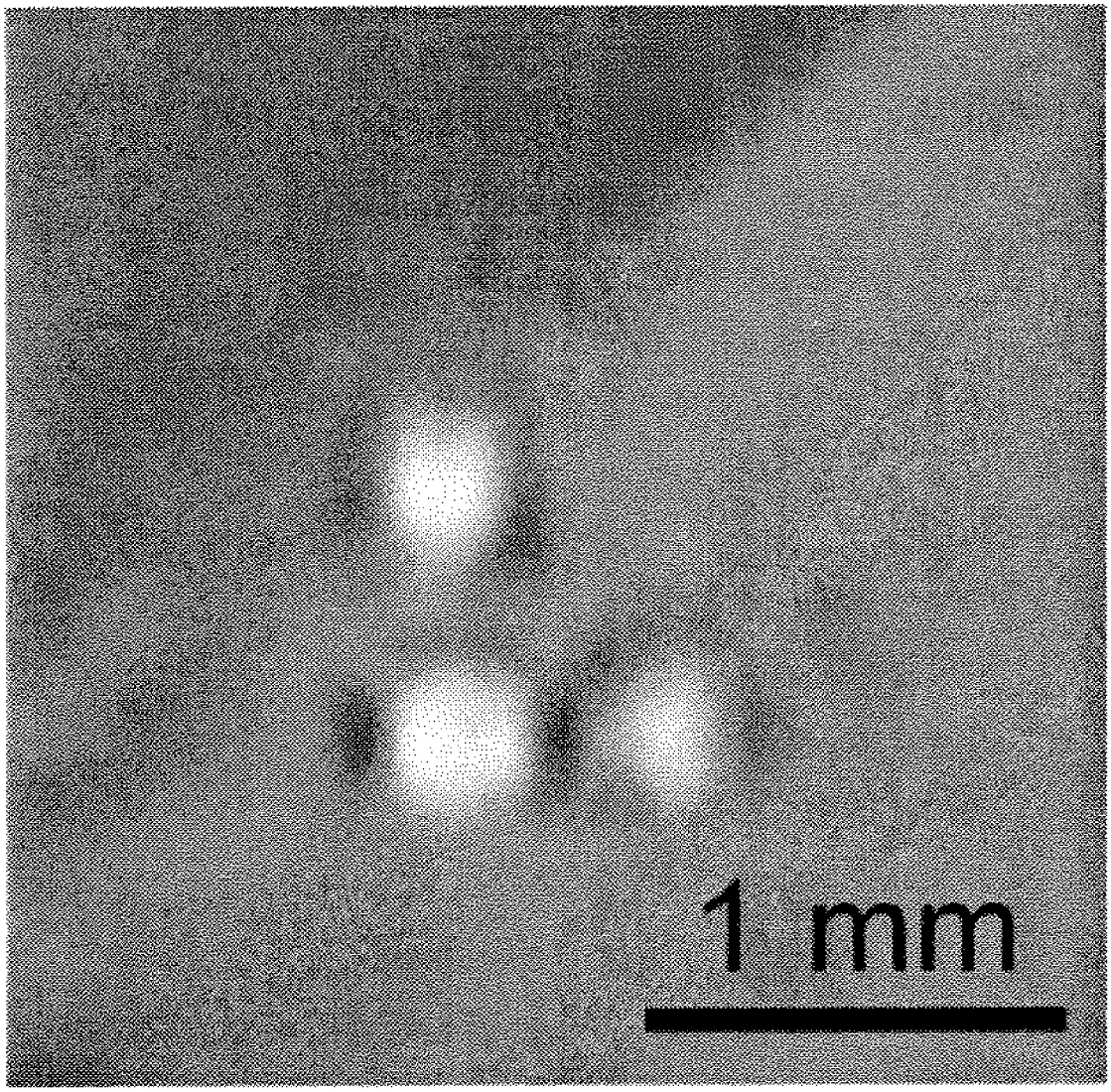

FIGS. 22A and 22B are photographs showing operational states of the nanostructures included in the field emission display device manufactured by using the field emission device of Experimental Example 1. Specifically, FIG. 22A is a photograph taken in close proximity to the upper portion of the field emission display device, and FIG. 22B is a photograph taken at somewhat of a distance from the upper portion of the field emission display device.

As shown in FIGS. 22A and 22B, light emission was observed from the portion where the nanostructures were positioned. In addition, because light emission is noticed even under external illumination, it can be noted that the field emission display device has excellent characteristics. In addition, because the nanostructures were formed by patterning the mask layer in the "L" shape, the field emission display device can be manufactured as a compact display (micropixel display).

Experimentation of Field Effect Transistor (FET) of Experimental Example 1

In order to investigate the reason why the nanostructures of Experimental Example 1 have such excellent electric field emission characteristics, electrical characteristics of the nanostructures were analyzed. First, the nanostructures of Experimental Example 1 were scraped off from the substrate with knife. Next, the separated nanostructures were mixed with ethanol, and were then distributed on an insulative substrate and disposed at accurate positions by using an electron microscope. 300 Å of Ti and 500 Å of Au were deposited on the end portions of the nanostructures by using thermal evaporation or electron beam evaporation, which were then thermally treated for one minute at about 300° C. to form an ohmic electrode.

Figure 23:
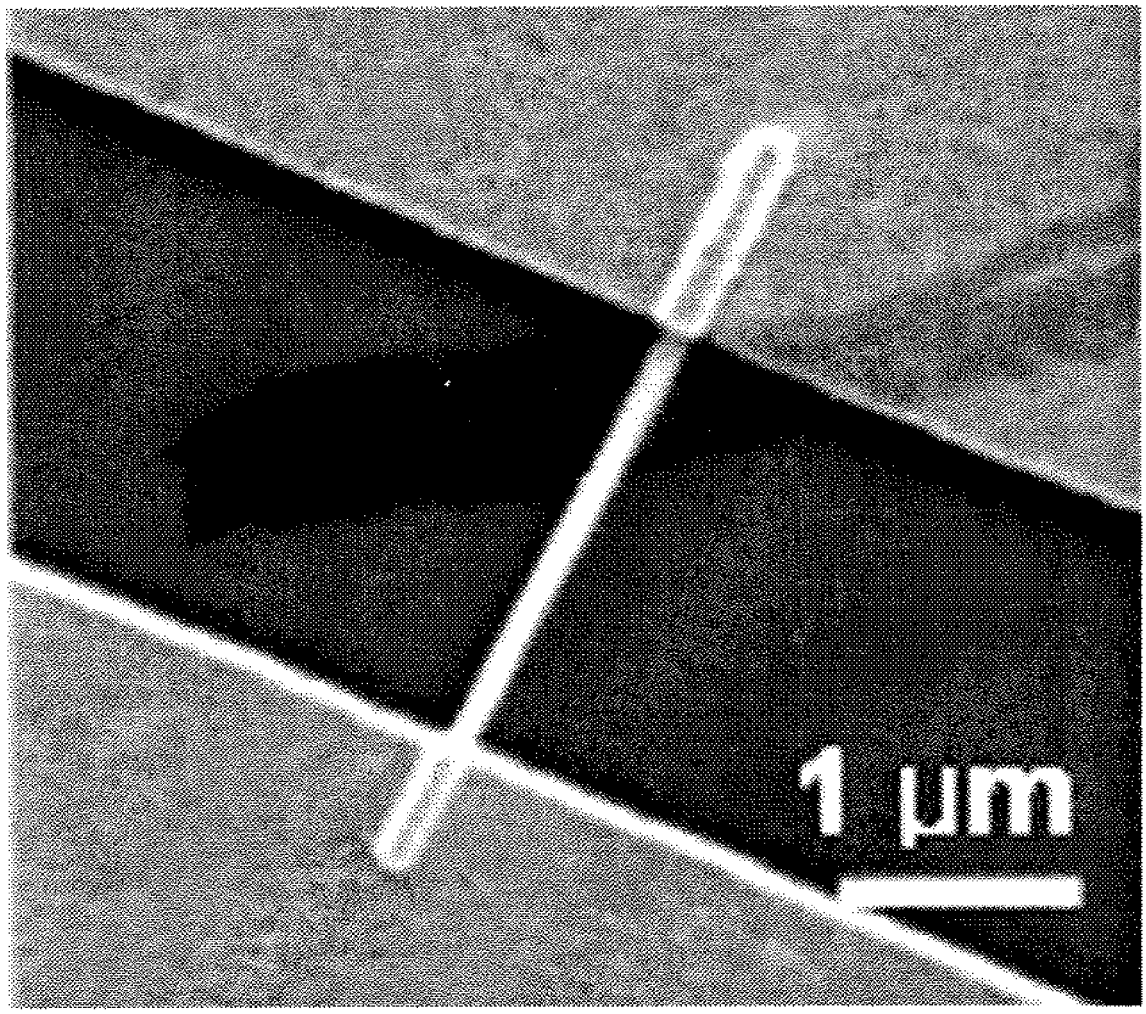
FIG. 23 shows a scanning electron microscope photograph of a field effect transistor (FET) fabricated by using the field emission device of Experimental Example 1 according to an embodiment of the present invention.

FIG. 23 shows a scanning electron microscope photograph of an FET fabricated according to the above-described method.

The FET was fabricated by using the field emission device of Experimental Example 1. As shown in FIG. 23, the single nanostructure of the FET was aligned horizontally.

Results of Experimentation of the FET of Experimental Example 1

A gate voltage of the FET was measured at 20V intervals from 20V to −20V by using a silicon substrate as a gate. Also, with a drain voltage fixed to be constant, a drain current of the FET was measured while changing the gate voltage from −20V to 20V.

Figure 24A:
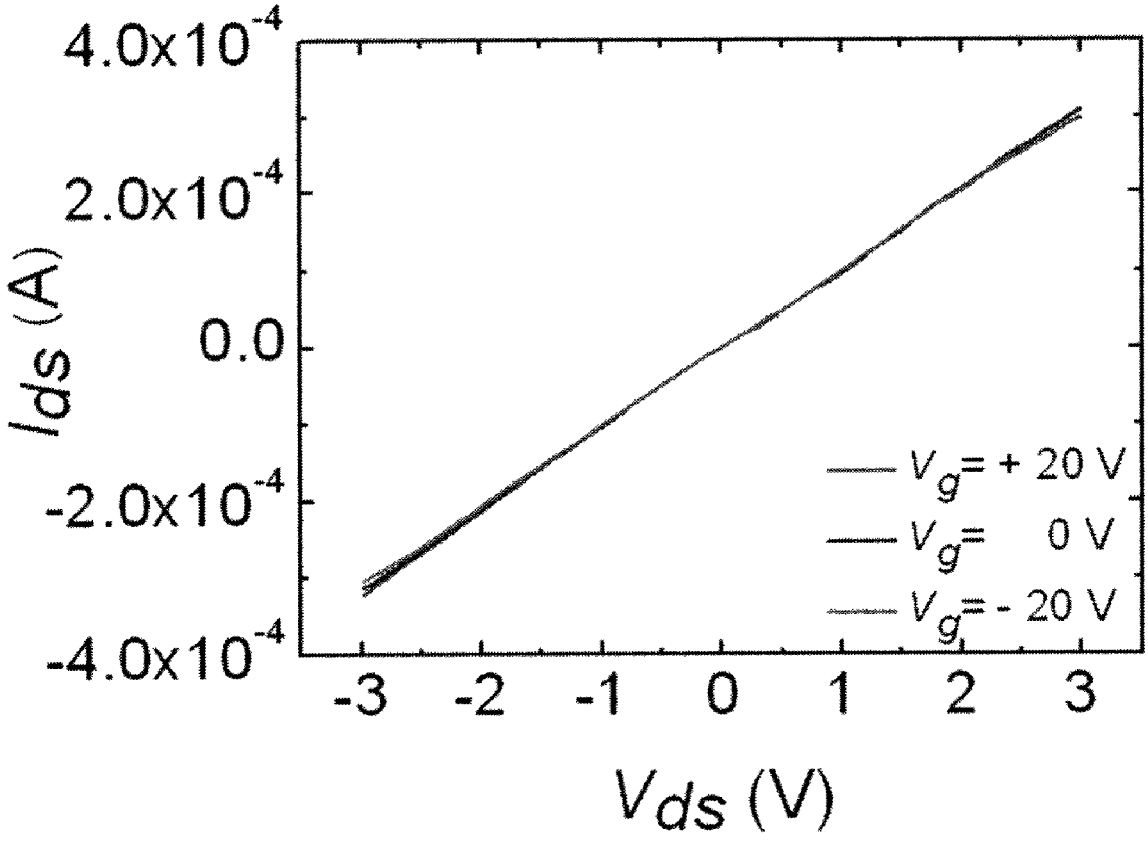
FIGS. 24A and 24B are graphs showing electrical characteristics of the nanostructures included in the FET of FIG. 23, respectively.
Figure 24B:
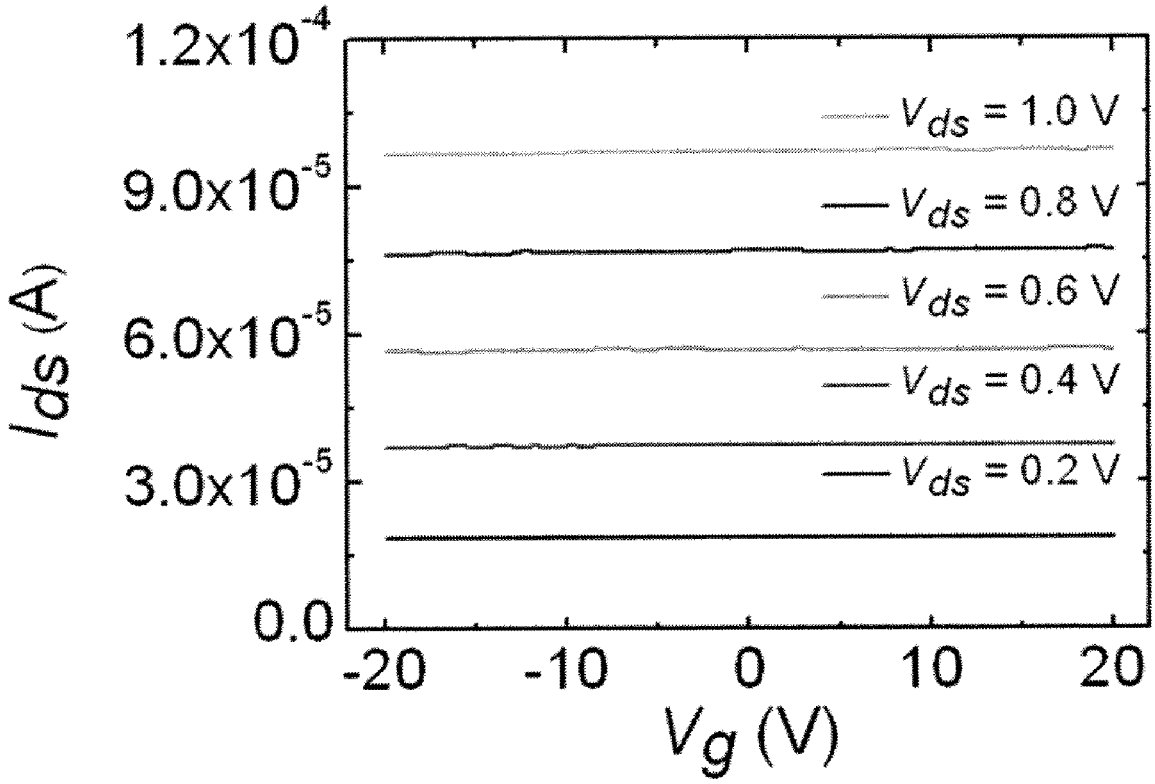

FIGS. 24A and 24B are graphs showing electrical characteristics of the FET fabricated by using the field emission device of Experimental Example 1, according to an embodiment of the present invention. Specifically, FIG. 24A is a graph showing drain voltage (Vds—drain current (Ids), and FIG. 24B is a graph showing gate voltage (Vg)—drain current (Ids).

As shown in FIG. 24A, the drain voltage (Vds) and the drain current (Ids) were formed to have a linear form as they are proportional to each other. Accordingly, it can be noted that an ohmic electrode with quite small contact resistance was formed.

With reference to FIG. 24B, although the gate voltage Vg was changed, the drain current Ids was not changed. That is, the nanostructures exhibit characteristics of a metal in that the size of current flowing therein does not change. Specific resistance (ρ) of the nanostructures made of zinc oxide was about 0.15 mΩ, which is equivalent to one-tenth to one-hundredth of that of a zinc oxide thin film. The reason why the specific resistance of the zinc oxide nanostructures was that small is because the density of charge carriers of the nanostructures was increased as impurities of a hydrothermal synthesis solution were introduced into the nanostructures. That is, because the density of the charge carriers of the nanostructures fabricated by using the hydrothermal synthesis method was increased, the electron emission efficiency of the nanostructures was enhanced.

Experimentation of Optical Characteristics of Experimental Example 1

In order to perform an experiment on optical characteristics of the nanostructures of Experimental Example 1, a low temperature (10K) photoluminescence (PL) measurement was performed on the nanostructures. The PL measurement was made by using a 325 nm wavelength of a He—Cd laser as a excitation source. In the PL measurement, the optical characteristics of the material were evaluated through recombination of electrons and holes in a band gap. Results of experimentation of optical characteristics of Experimental Example 1

Figure 25A:
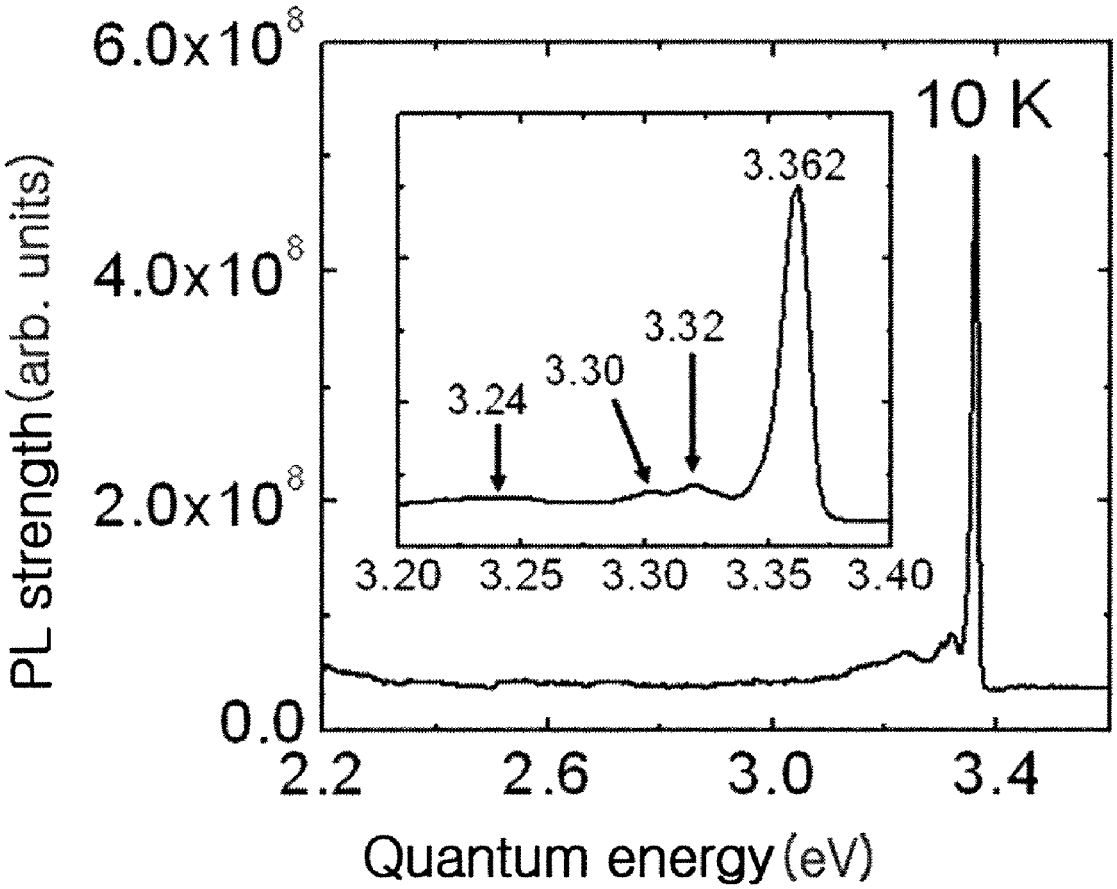
FIGS. 25A and 25B are graphs showing the results obtained by measuring optical characteristics of the nanostructures included in the field emission device manufactured according to Experimental Example 1, by using a low temperature photoluminescence spectrum measurement.
Figure 25B:
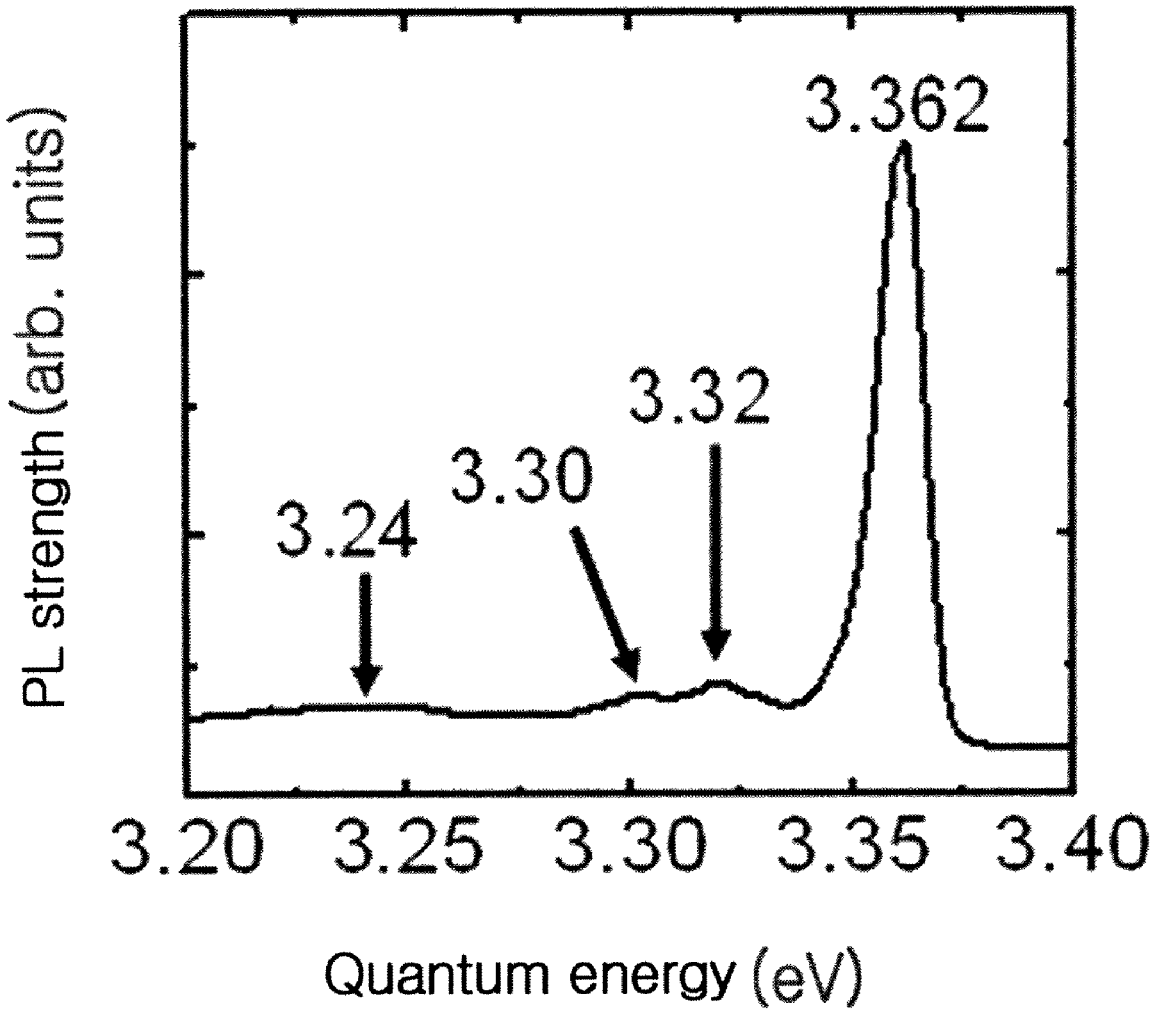

FIGS. 25A and 25B are graphs showing the results obtained by measuring optical characteristics of the nanostructures included in the field emission device manufactured according to Experimental Example 1, by using the low temperature PL spectrum measurement. FIG. 25B shows a magnified PL peak of the nanostructures of FIG. 25A.

As shown in FIG. 25A, a near-band edge emission (NBE) peak of the zinc oxide was observed from the nanostructures grown from the substrate when the low temperature (10K) PL measurement was performed.

In addition, as shown in FIG. 25B, the NBE peak was mostly 3.362 eV. Four main peaks were observed at energy positions of 3.24 eV, 3.30 eV, 3.32 eV, and 3.362 eV.

Here, the peak of 3.362 eV was an emission by excitons combined with neutral donors in crystal. It was presumed that the cause of the emission peak of 3.362 eV was because a shallow donor level was formed by a hydrogen donor. In addition, the peaks of 3.24 eV, 3.30 eV, and 3.32 eV were ascribed to two electron satellite transitions, donor acceptor pair (DAP) transition and longitudinal optical (LO) phonon replica of the DAP.

The intesity of a deep level peak generated by a defect such as impurities or the like was very small. Compared with a nanoneedle made of zinc oxide grown by a chemical vapor deposition method using a metal such as gold as a catalyst, the deep level of the nanostructures of Experimental Example 1 was observed to be very small. Therefore, it was noted that the nanostructures have few defects and have excellent optical characteristics.

As described above, from the fact that the excitons combined with the neutral donors were observed in most NBE and the fact that free excitons were not observed even at the lower temperature of 10K, it was noted that few impurities were contained in the nanostructures of Experimental Example 1 to form the shallow donor level. In addition, the increase in the density of the charge carriers due to the impurities of the nanostructures made the nanostructures have excellent electron emission characteristics.

EXPERIMENTAL EXAMPLE 2

Nanostructures were fabricated in the same manner as in the above-described Experimental Example 1, except for the deposition temperature of the seed layer within a metal organic chemical vapor deposition reactor. That is, the seed layer was deposited in the metal organic chemical vapor deposition reactor while it was maintained at 450° C., and nanostructures were grown from the seed layer.

Figure 26:
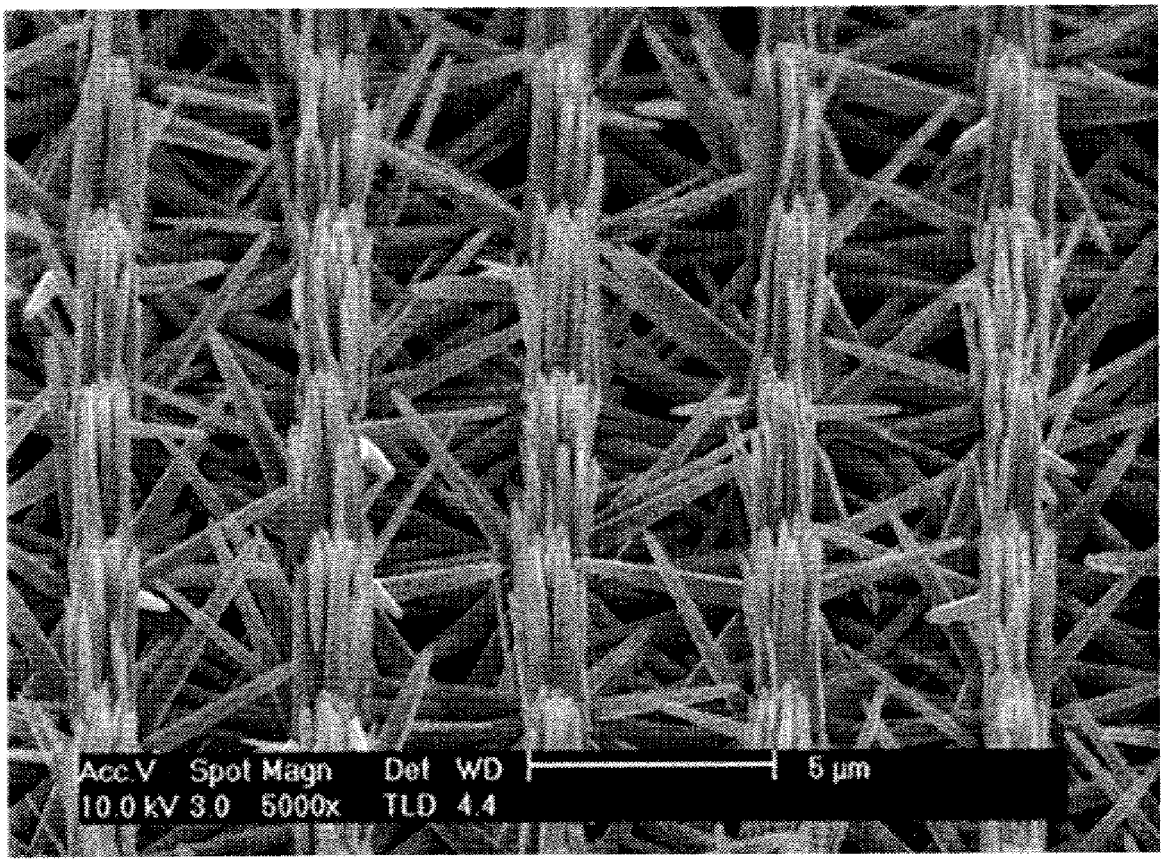
FIGS. 26 to 28 are stereoscopic scanning electron microscope photographs of nanostructures included in the field emission device manufactured according to Experimental Examples 2 to 4.

FIG. 26 is a stereoscopic scanning electron microscope photograph of nanostructures included in the field emission device manufactured according to Experimental Example 2.

As shown in FIG. 26, the angle formed between the nanostructures and the substrate in Experimental Example 2 is different from the angle formed between the nanostructures and the substrate in Experimental Example 1. That is, the fabricated nanostructures were mostly aligned to be perpendicular to the surface of the substrate. In addition, nanostructures perpendicular to the substrate and nanostructures at an angle within the range of about 30° to 60° to the substrate were fabricated.

EXPERIMENTAL EXAMPLE 3

Nanostructures were fabricated in the same manner as in the above-described Experimental Example 2, except for the deposition temperature of the seed layer within the metal organic chemical vapor deposition reactor. That is, the seed layer was deposited in the metal organic chemical vapor deposition reactor while it was maintained at 350° C., and nanostructures were grown from the seed layer.

Figure 27:
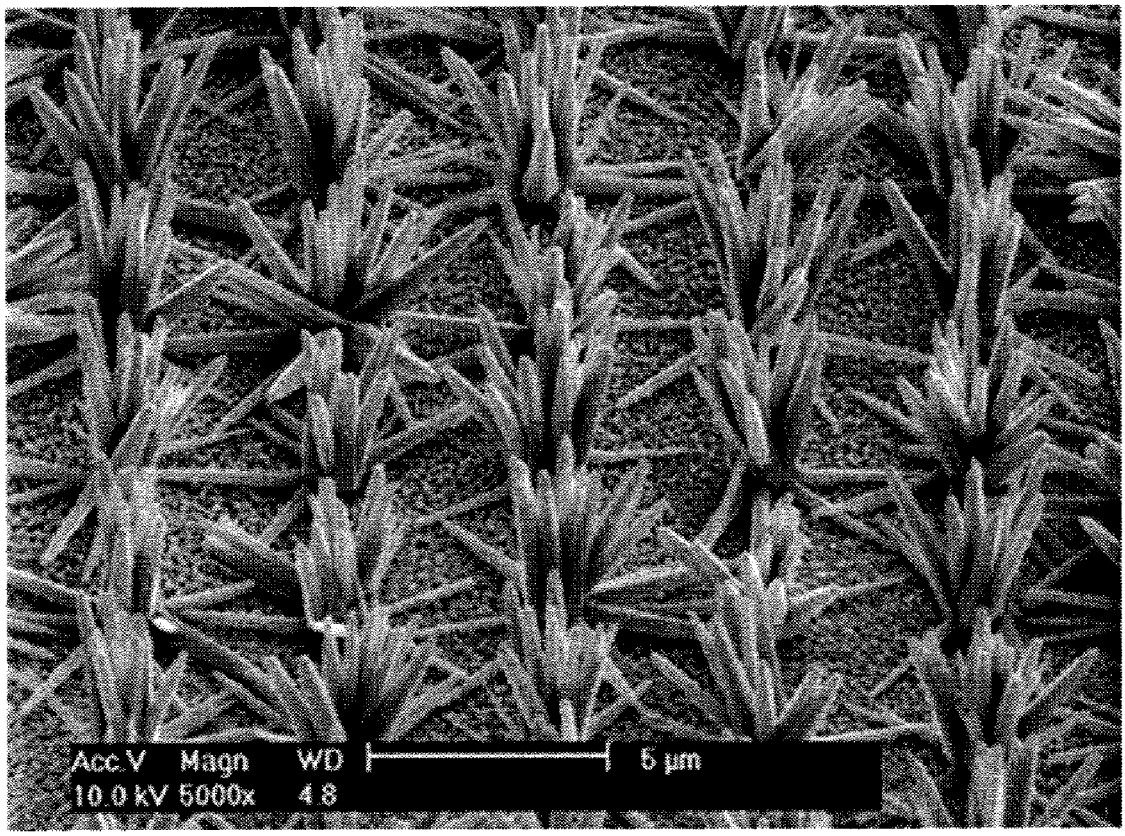

FIG. 27 is a stereoscopic scanning electron microscope photograph of nanostructures included in the field emission device manufactured according to Experimental Example 3.

As shown in FIG. 27, the fabricated nanostructures were mostly aligned to be perpendicular to the surface of the substrate. However, the vertical alignment of the nanostructures according to Experimental Example 3 was somewhat degraded compared to the nanostructures of Experimental Example 2.

EXPERIMENTAL EXAMPLE 4

Nanostructures were fabricated in the same manner as in the above-described Experimental Example 2, except for the deposition temperature of the seed layer in the metal organic chemical vapor deposition reactor. The seed layer was deposited in the metal organic chemical vapor deposition reactor maintained at room temperature, and nanostructures were grown from the seed layer.

Figure 28:
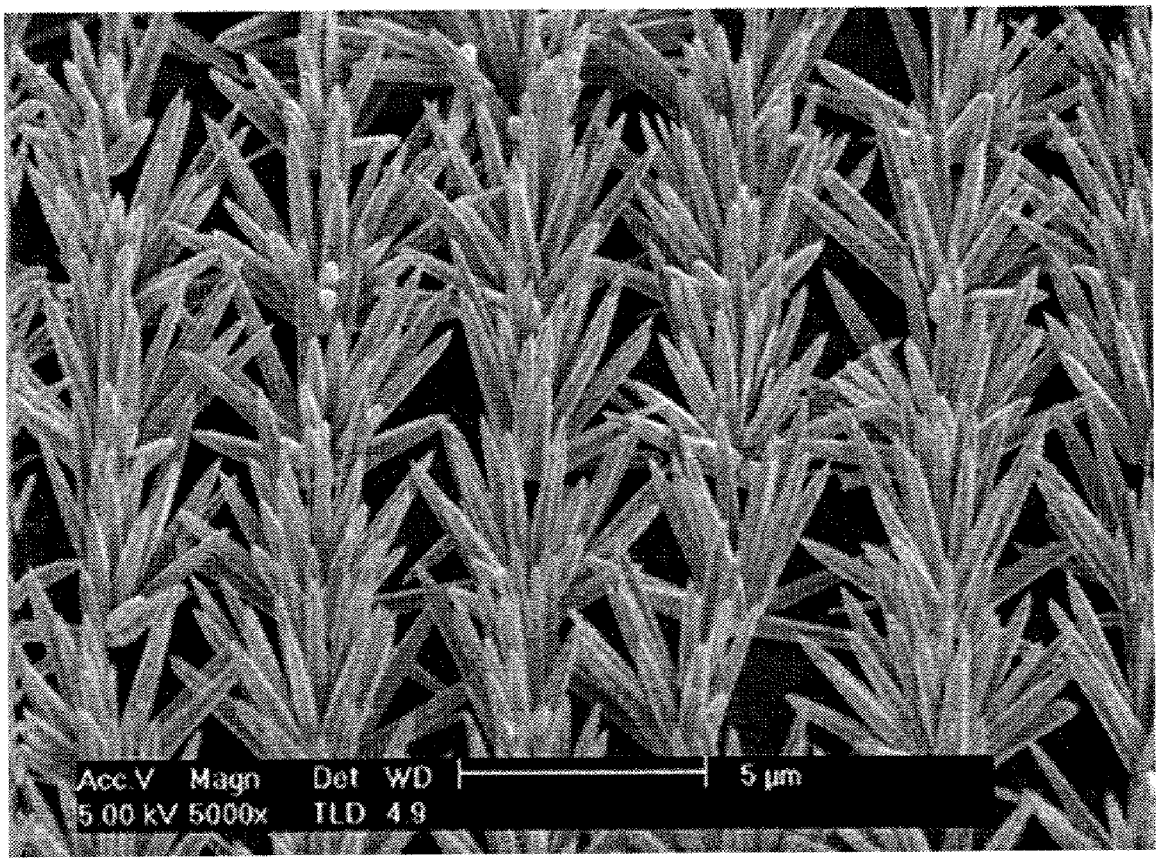

FIG. 28 is a stereoscopic scanning electron microscope photograph of nanostructures included in the field emission device manufactured according to Experimental Example 4.

As shown in FIG. 28, most nanostructures were at an angle within the range of about 30° to 60° with the substrate. The spatial arrangement of the nanostructures can be adjusted by determining a crystallographic direction of the seed layer according to a deposition temperature of the seed layer.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A field emission device comprising:

a substrate;

an electrode positioned on the substrate;

a seed layer positioned on the electrode;

a mask layer positioned on the seed layer and comprising one or more openings; and a plurality of nanostructures positioned on the seed layer via the openings and formed to extend radially, wherein the one or more openings are formed to be spaced apart from each other with a certain pattern, wherein the plurality of nanostructures are configured to emit electrons upon receiving an electric field by applying a voltage from the electrode and the seed layer, wherein the plurality of nanostructures are regularly arranged along an x-axis direction and a y-axis direction, and among the plurality of nanostructures neighboring nanostructures have substantially the same distance therebetween, wherein end portions of one or more nanostructures, among the plurality of nanostructures, have a pointed shape, wherein the end portion of the nanostructure refers to a region from a boundary point at which the diameter of the nanostructure, which is maintained to be substantially the same, starts to become smaller to the tip of the nanostructure, wherein the end portions have the shape of an isosceles triangle, and a ratio of the height to the length of the base of the isosceles triangle is 2 to 4, and wherein a ratio of the length of one or more nanostructures, among the plurality of nanostructures, obtained by cutting the one or more nanostructures in a direction perpendicular to a surface of the substrate to the length thereof obtained by cutting in a direction parallel to the surface of the substrate is 10 or larger.

2. The device of claim 1, wherein neighboring nanostructures, among the plurality of nanostructures, have an angle within the range of 20° to 60° therebetween.

3. The device of claim 2, wherein the angles between the neighboring nanostructures are substantially the same.

4. The device of claim 3, wherein the plurality of nanostructures comprise one or more nanostructures extending substantially at a right angle with respect to the surface of the substrate, and the other nanostructures are positioned to be symmetrical based on the one or more nanostructures.

5. The device of claim 1, wherein one or more nanostructures, among the plurality of nanostructures, have one or more shapes selected from the group consisting of a nanorod, a nanotube, a nanoneedle, and a nanowall.

6. The device of claim 1, wherein one or more nanostructures, among the plurality of nanostructures, form an angle with the surface of the substrate within the range of 30° to 150°.

7. The device of claim 1, wherein the plurality of nanostructures comprise a plurality of nanostructures extending substantially at a right angle to the surface of the substrate.

8. The device of claim 1, wherein the material of the nanostructures positioned on the seed layer is the same as that of the seed layer.

9. The device of claim 8, wherein the nanostructures grow from the seed layer.

10. The device of claim 1, wherein one or more nanostructures, among the plurality of nanostructures, comprise one or more elements selected from the group consisting of zinc oxide (ZnO), indium oxide (InO), tin oxide (SnO), tungsten oxide (WO), ferric oxide ($Fe_2O_3$), cadmium oxide (CdO), magnesium oxide (MgO), gallium nitride (GaN), aluminum nitride (AIN), silicon carbide (SiC), copper sulfide (CuS), copper oxide (CuO), molybdenum sulfide ($MOS_2$), molybdenum dioxide ($MoO_2$), molybdenum trioxide ($MoO_3$), tungsten (W), and molybdenum (Mo).

11. The device of claim 10, wherein one or more nanostructures further comprise one or more elements selected from the group consisting of Al, Mg, Cd, Ni, Ca, Mn, La, Ta, Ga, Ln, Cr, B, N, and Sn.

12. A field emission display device comprising:

a first substrate;

a first electrode positioned on the first substrate;

a seed layer positioned on the first electrode;

a mask layer positioned on the seed layer and comprising one or more openings;

a plurality of nanostructures positioned on the seed layer and formed to extend radially at the openings;

a second substrate positioned apart from the first substrate and comprising a phosphor layer formed on a surface facing the plurality of nanostructures; and a second electrode facing the first substrate and positioned on the second substrate, wherein the one or more openings are formed to be spaced apart from each other with a certain pattern, wherein the plurality of nanostructures are configured to emit electrons upon receiving an electric field by applying a voltage from the first electrode and the seed layer, and the electrons collide with the phosphor layer to allow visible rays to emit via the second substrate, wherein the plurality of nanostructures are regularly arranged along an x-axis direction and a y-axis direction, and among the plurality of nanostructures neighboring nanostructures have substantially the same distance therebetween, wherein end portions of one or more nanostructures, among the plurality of nanostructures, have a pointed shape, wherein the end portion of the nanostructure refers to a region from a boundary point at which the diameter of the nanostructure, which is maintained to be substantially the same, starts to become smaller to the tip of the nanostructure, wherein the end portions have the shape of an isosceles triangle, and a ratio of the height to the length of the base of the isosceles triangle is 2 to 4, and wherein a ratio of the length of one or more nanostructures, among the plurality of nanostructures, obtained by cutting the one or more nanostructures in a direction perpendicular to a surface of the substrate to the length thereof obtained by cutting in a direction parallel to the surface of the substrate is 10 or larger.

13. The device of claim 12, wherein neighboring nanostructures, among the plurality of nanostructures, form an angle within the range of 20° to 60° therebetween.

14. The device of claim 13, wherein the angles between the neighboring nanostructures are substantially the same.

15. The device of claim 14, wherein the plurality of nanostructures comprise one nanostructure at a right angle with respect to the surface of the substrate, and the other nanostructures are positioned to be symmetrical based on the one nanostructure.

16. The device of claim 12, wherein one or more nanostructures, among the plurality of nanostructures, form an angle with the surface of the substrate within the range of 30° to 150°.

* * * * *